US006948315B2

(12) United States Patent
Kirby et al.

(10) Patent No.: US 6,948,315 B2
(45) Date of Patent: Sep. 27, 2005

(54) METHOD AND APPARATUS FOR A WASTE HEAT RECYCLING THERMAL POWER PLANT

(76) Inventors: Timothy Michael Kirby, 2366 Louisiana Hwy. 1, Grand Isle, LA (US) 70358; Wanda Marie Kirby, 2366 Louisiana Hwy. 1, Grand Isle, LA (US) 70358

( * ) Notice: Subject to any disclaimer, the term of this patent is extended or adjusted under 35 U.S.C. 154(b) by 164 days.

(21) Appl. No.: 10/774,880

(22) Filed: Feb. 9, 2004

(65) Prior Publication Data

US 2005/0178124 A1 Aug. 18, 2005

(51) Int. Cl.[7] ..... F01K 7/34
(52) U.S. Cl. ..... 60/653; 60/676; 60/679
(58) Field of Search ..... 60/653, 670, 676, 60/679

(56) References Cited

U.S. PATENT DOCUMENTS

| | | | | |
|---|---|---|---|---|
| 3,950,949 A | * | 4/1976 | Martin et al. | 60/641.8 |
| 4,372,126 A | | 2/1983 | Sebald | |
| 4,417,446 A | | 11/1983 | Nakamoto | |
| 4,907,410 A | | 3/1990 | Chang | |
| 5,087,175 A | | 2/1992 | Raizman | |
| 5,640,842 A | | 6/1997 | Bronicki | |

(Continued)

OTHER PUBLICATIONS

Carl D. Shields, Boilers: Types, Characteristics, and Functions—C 1961 (reissued 1982), ppg. 500–506, 508–510, & 524–526, ISBN 07–056801–4, McGraw–Hill, Inc. New York, NY.

Hans Gartmann (Editor), De Laval Engineering Handbook—C 1970, ppg. 3–57, 4–21 –4–26, 5–2 –5–3, 5–5 –5–7, 6–2 –6–3, 6–6, 6–9, 6–61 –6–62, 6–64 –6–66 8–1 –8–7, 8–14, & 8–15, C 1970, ISBN 07–022908–2, McGraw–Hill, Inc. New York, NY.

Robert L. Daugherty, & Joseph B. Franzini, Ph.D, Fluid Mechanics with Engineering Applications—ppg 520 & 521, C 1977, ISBN 0–07–015427–9, McGrawl–Hill, Inc. New York, NY.

(Continued)

*Primary Examiner*—Hoang Nguyen

(57) ABSTRACT

This invention, a waste heat recycling thermal power plant (1000), extracts heat from the environment, and concentrates this heat to produce a cfc super-ambient temperature heat source (1330) having an elevated temperature sufficient to supply a useable heat flow to an incorporated heat engine (e.g., Rankine cycle, Stirling cycle, Seebeck cycle, etc.) flow circuit (1400). Further, waste heat recycling thermal power plant (1000) produces an sfc sub-ambient temperature heat sink (1250), thus increasing the applied temperature differential, thereby permitting the thermal efficiency of ihefc pressure expansion device (1460) to be increased as well. Lastly, waste heat recycling thermal power plant (1000) captures for reuse, much of the waste heat that its own operation liberates, thus lowering its net energy utilization per unit of mechanical power produced (a.k.a., heat rate, Btu/kwhr). In the main embodiment of its use, waste heat recycling thermal power plant (1000) would be used as the driver for a mod driven mechanical device (1520), specifically an electrical generator. Deriving its source heat by intercepting the heat that would be rejected to the environment by an electrical power generating station's cooling device, and routing this heat to waste heat recycling thermal power plant (1000). Then converting this heat to mechanical power, and subsequently to electrical power. This would result in an improvement of the electrical power generating station's net electrical power generating capacity and fuel efficiency, while simultaneously reducing the quantity of thermal (and potentially chemical) pollution released to the environment.

24 Claims, 10 Drawing Sheets

Main embodiment, a waste heat recycling thermal power plant.

U.S. PATENT DOCUMENTS

| | | | | | |
|---|---|---|---|---|---|
| 5,860,279 | A | * | 1/1999 | Bronicki et al. | 60/655 |
| 5,925,223 | A | * | 7/1999 | Simpson et al. | 203/11 |
| 6,052,997 | A | * | 4/2000 | Rosenblatt | 60/653 |
| 6,253,552 | B1 | * | 7/2001 | Peletz, Jr. | 60/649 |
| 6,305,170 | B1 | | 10/2001 | Kitani | |
| 6,397,596 | B1 | | 6/2002 | Boyle | |
| 6,434,941 | B1 | | 8/2002 | Narutomi | |
| 6,584,794 | B2 | | 7/2003 | Takeuchi | |
| 6,606,860 | B2 | | 8/2003 | McFarland | |
| 6,674,054 | B2 | | 1/2004 | Boyers | |

OTHER PUBLICATIONS

Albert Thurmann, P.E., C.E.M., Fundamentals of Energy Engineering—113–117, 145, 146, 261–263, C1984, ISBN 0–13–338237–X, The Fairmont Press, Inc. Atlanta, GA.

Michael R. Lindeburg, P.E., 1001 Problems Solved Enmgineering Fundementals, p. 4–31, C 1988, ISBN 0–932276–90–3, Professional Publications, Inc. Belmont, CA.

Igor J. Karassik (et al.), Pump Handbook, ppg. 1.2, 1.3, 2.13, 2.51, 4.2–4.4, 4.8, 4.9, & 4.11, C 1986, ISBN 0–07–033302–5, McGraw–Hill Book Company, New York, NY.

Jan. F. Kreider, Ph.D (et al.), Solar Energy Handbook, ppg. 19–1–19–3, 19–6 –19–10, 22–1–22–9, 22–11, 22–12, & 22–14, C 1981, ISBN 0–07–035474–X, McGraw–Hill Book Company, New York, NY.

The Babcock & Wilcox Company, Steam: Its Generation and Use, ppg. 1–1–1–9, 2–1, 2–5, 2–8–2–17, 2–19, & 23–11, C 1978, LCCCN 77–90791, The Babcock & Wilcox Company, NYC.

Subrata Bhattachajee, Ph.D., T.E.S.T.: The Expert System for Thermodynamics (web edition), http://eng.edsu.sdu/testhome/index.html San Diego State University, School of Engineering, San Diego, CA.

* cited by examiner

Fig. 1A – Main embodiment, a waste heat recycling thermal power plant.
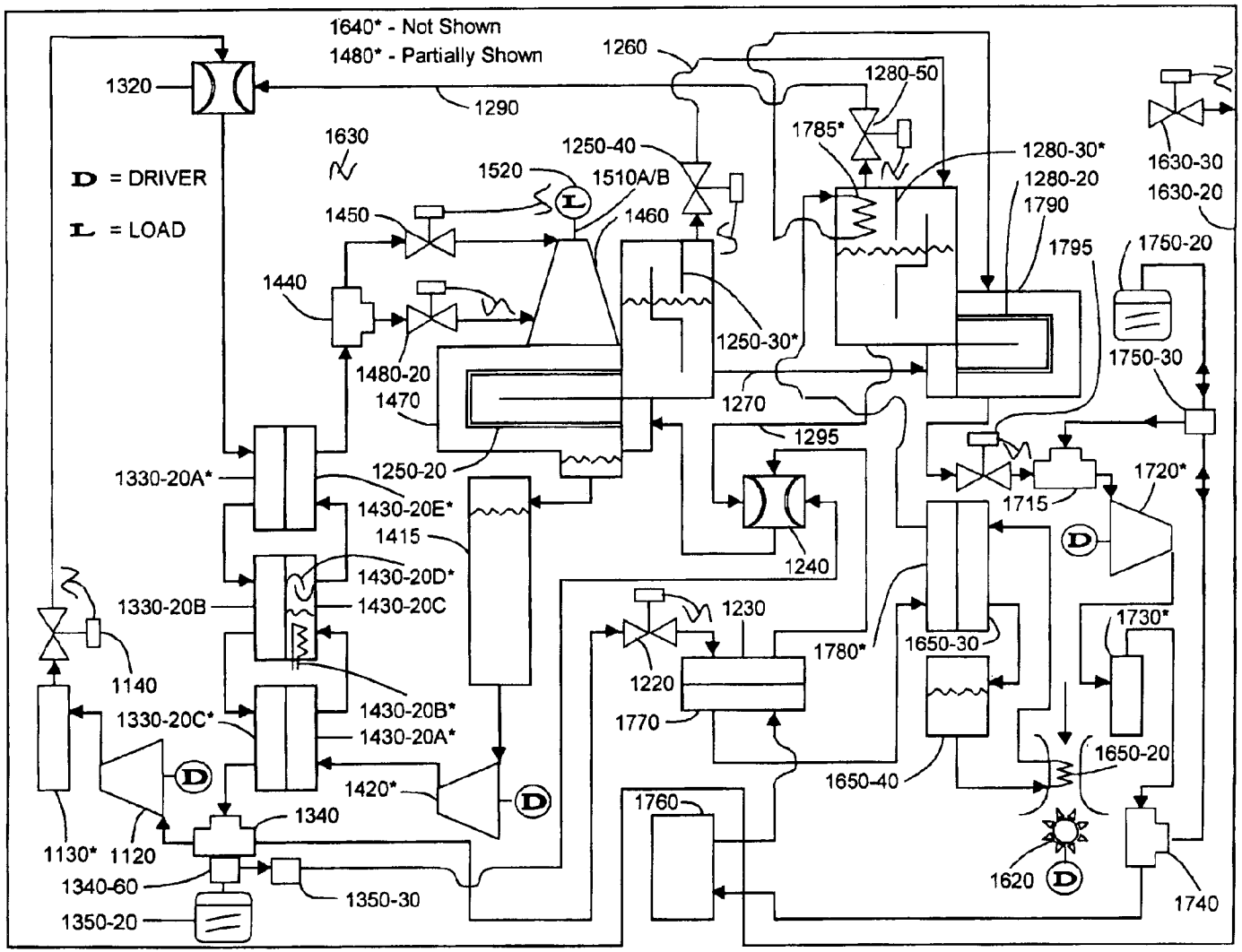

Fig. 1B – Main embodiment, motive flow circuit of a waste heat recycling thermal power plant.
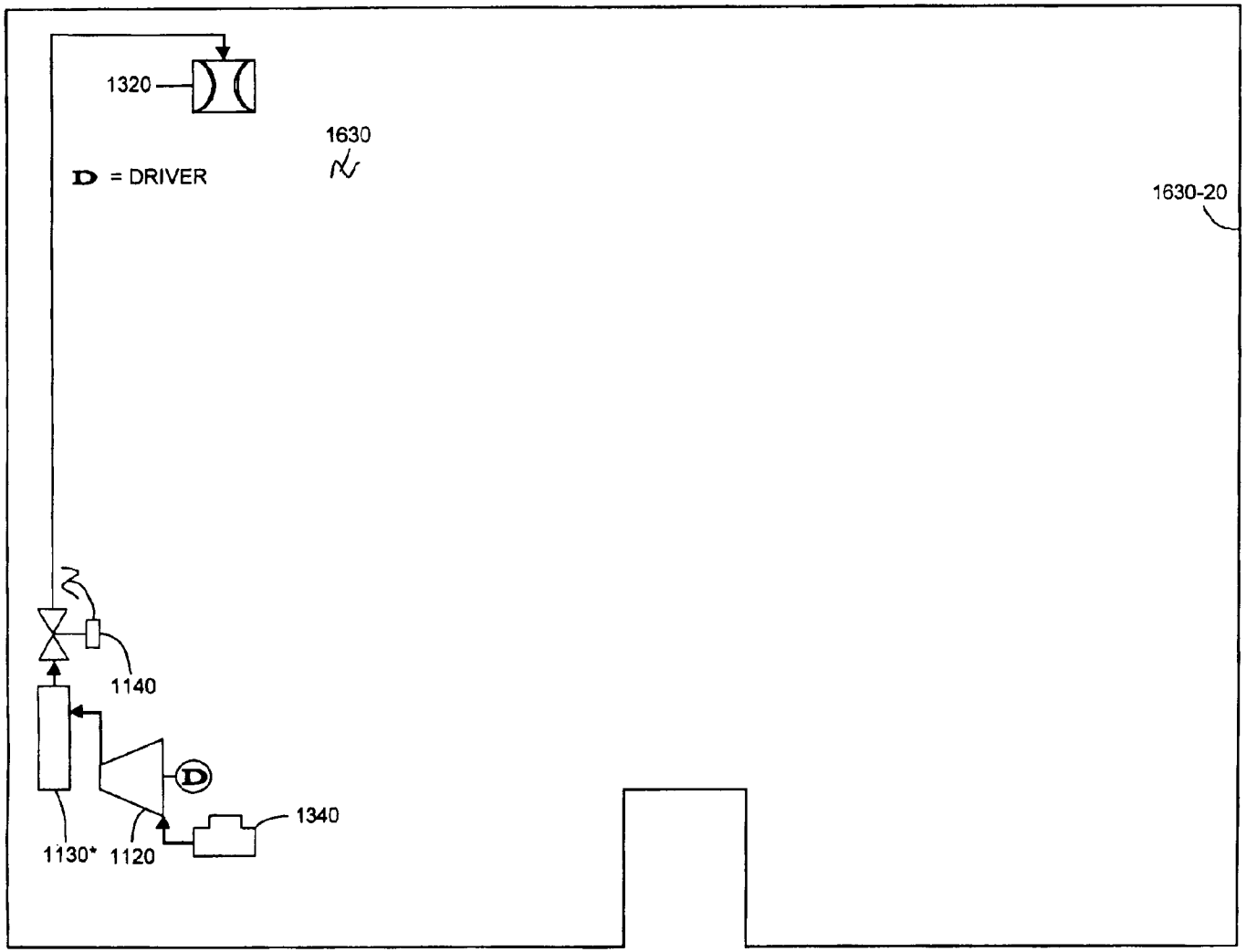

Fig. 1C – Main embodiment, suction flow circuit of a waste heat recycling thermal power plant.
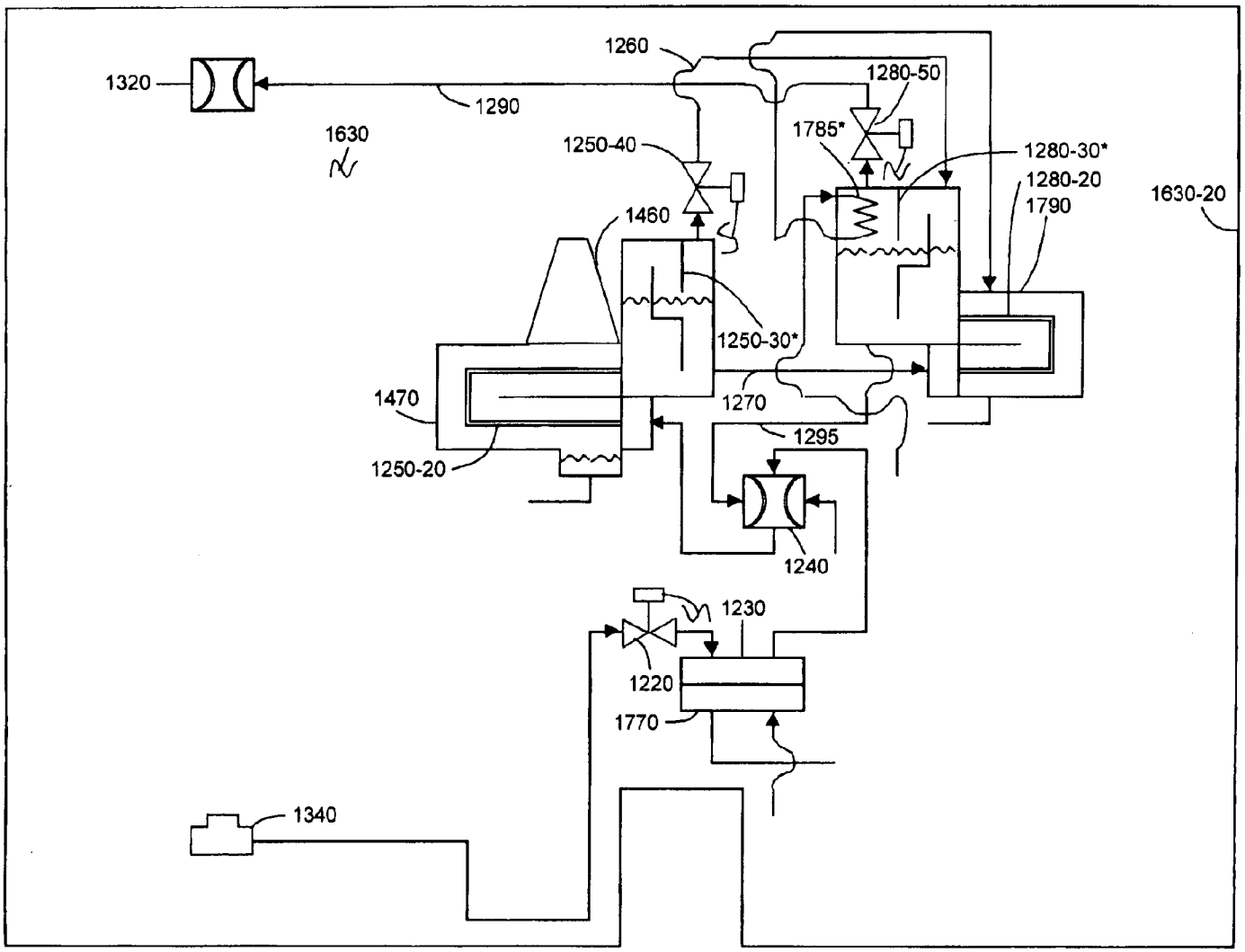

Fig. 1D – Main embodiment, conjoined flow circuit of a waste heat recycling thermal power plant.
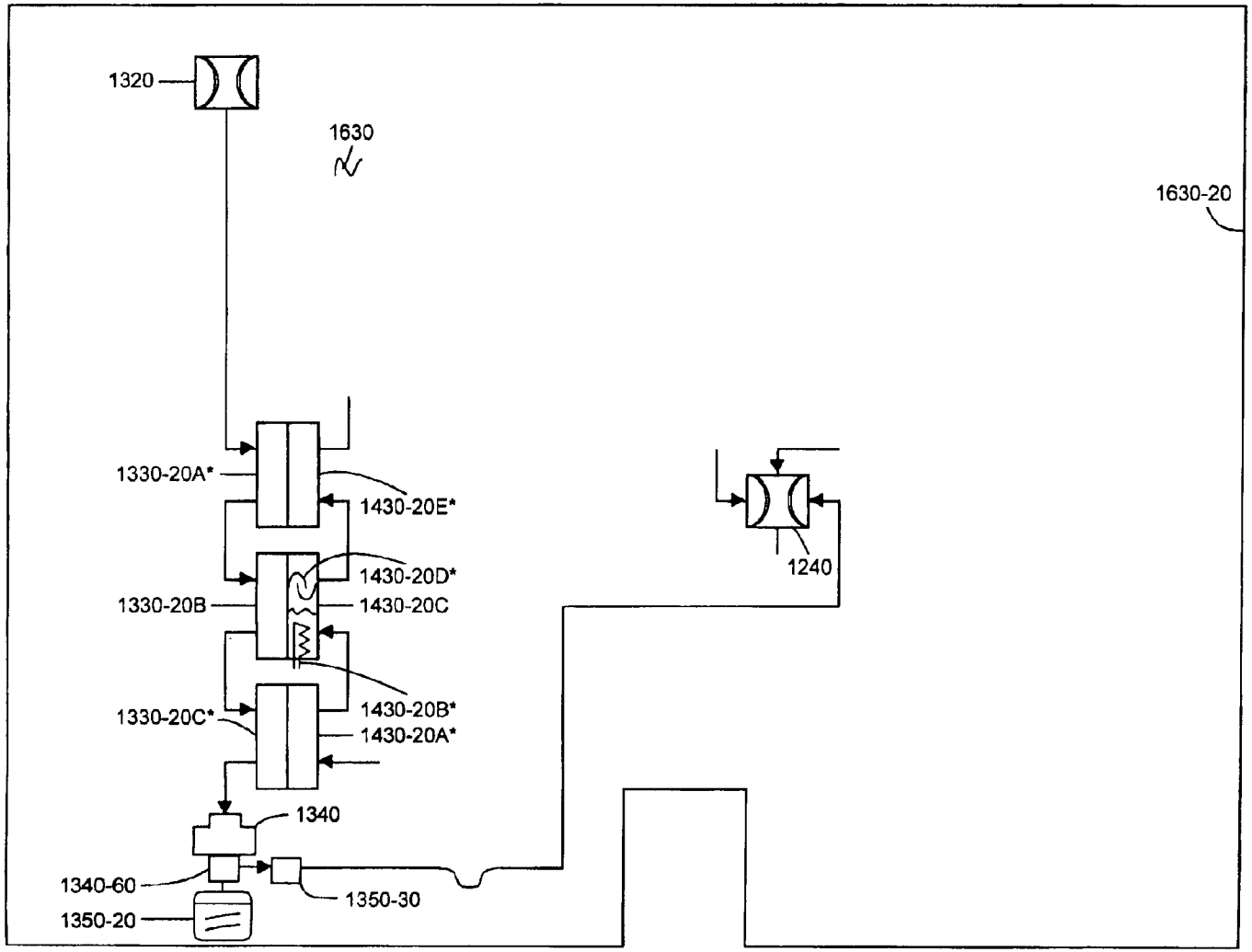

Fig. 1E – Main embodiment, incorporated heat engine flow circuit of a waste heat recycling thermal power plant.
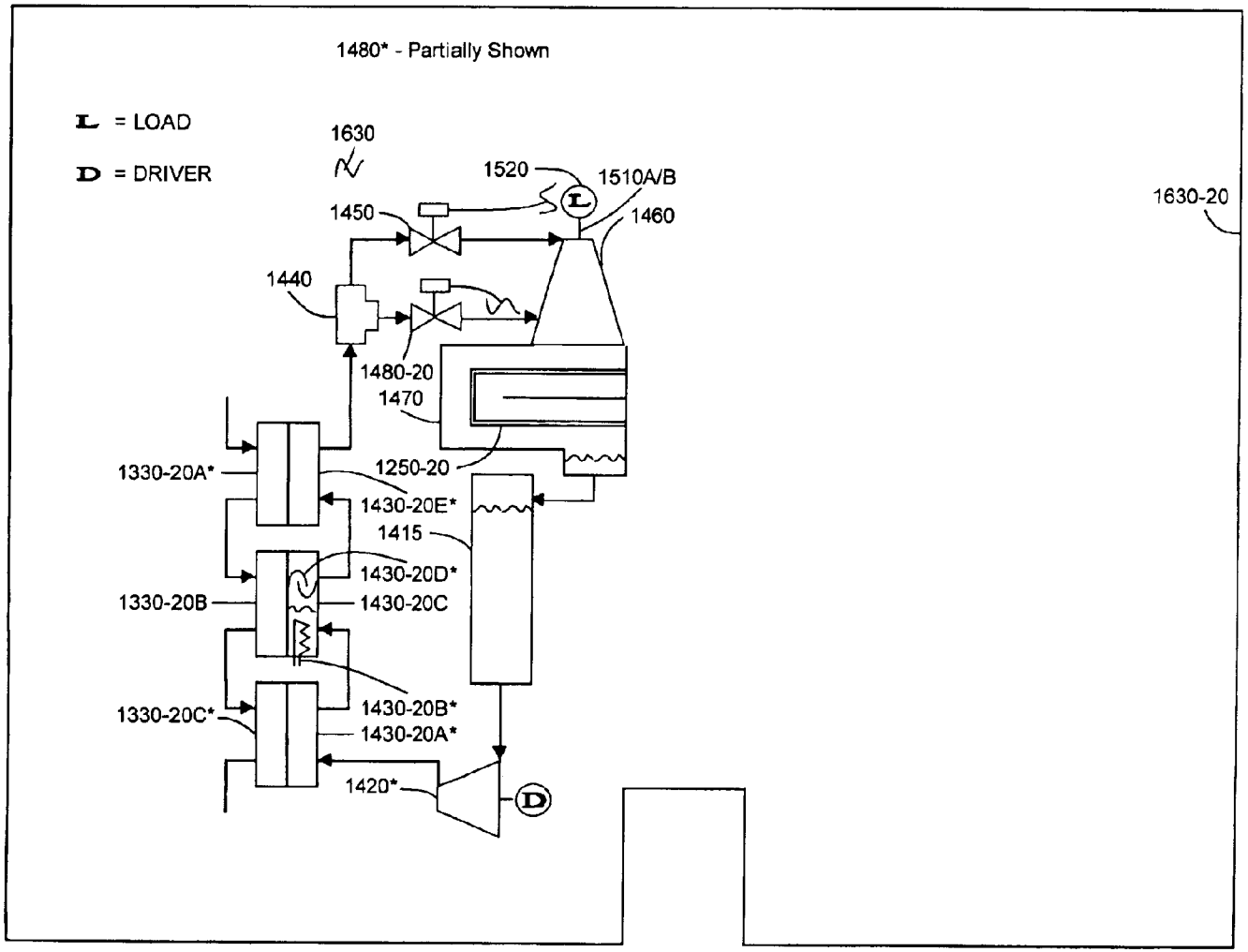

Fig. 1F – Main embodiment, mechanical output device of a waste heat recycling thermal power plant.
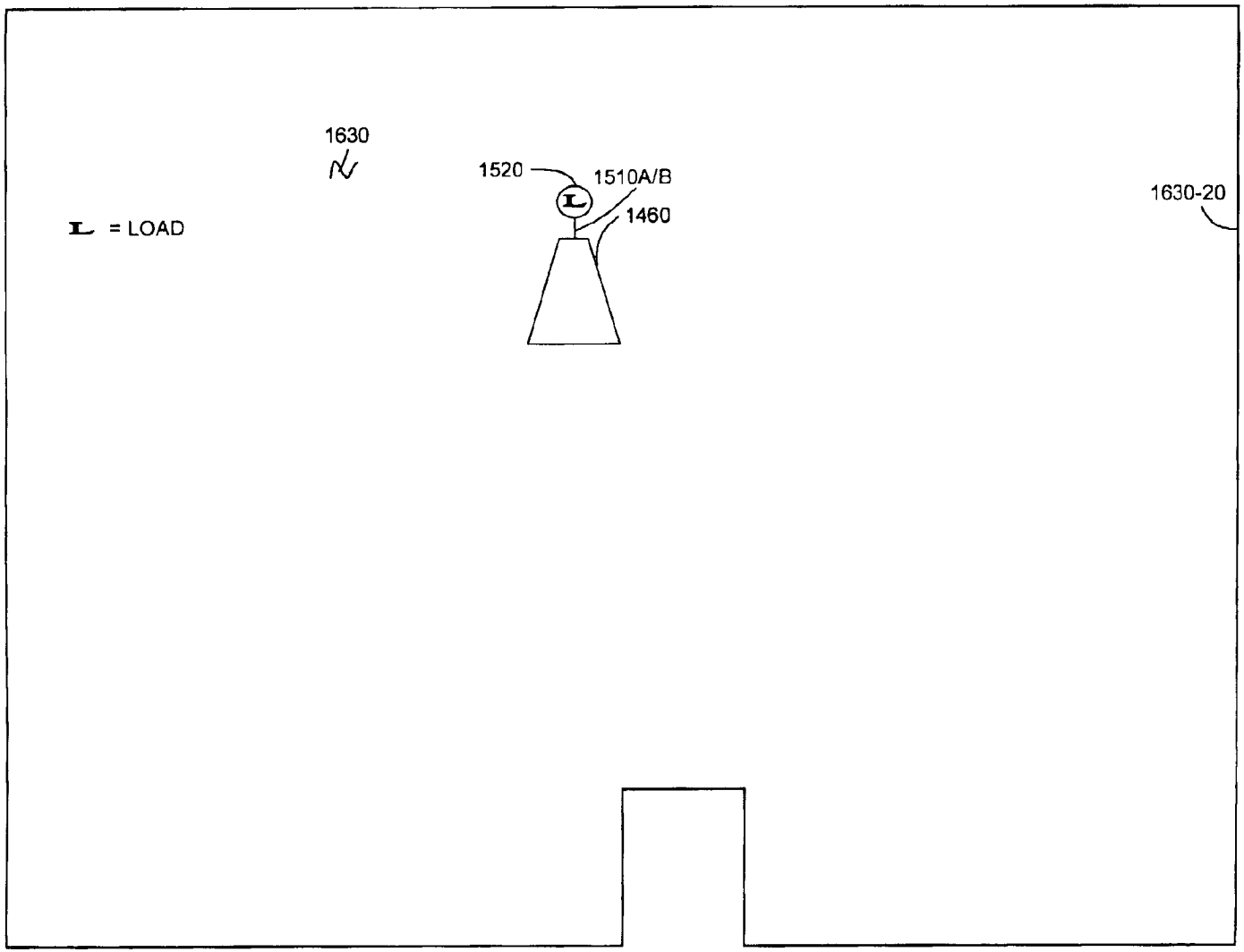

Fig. 1G – Main embodiment, heat recovery flow circuit of a waste heat recycling thermal power plant.
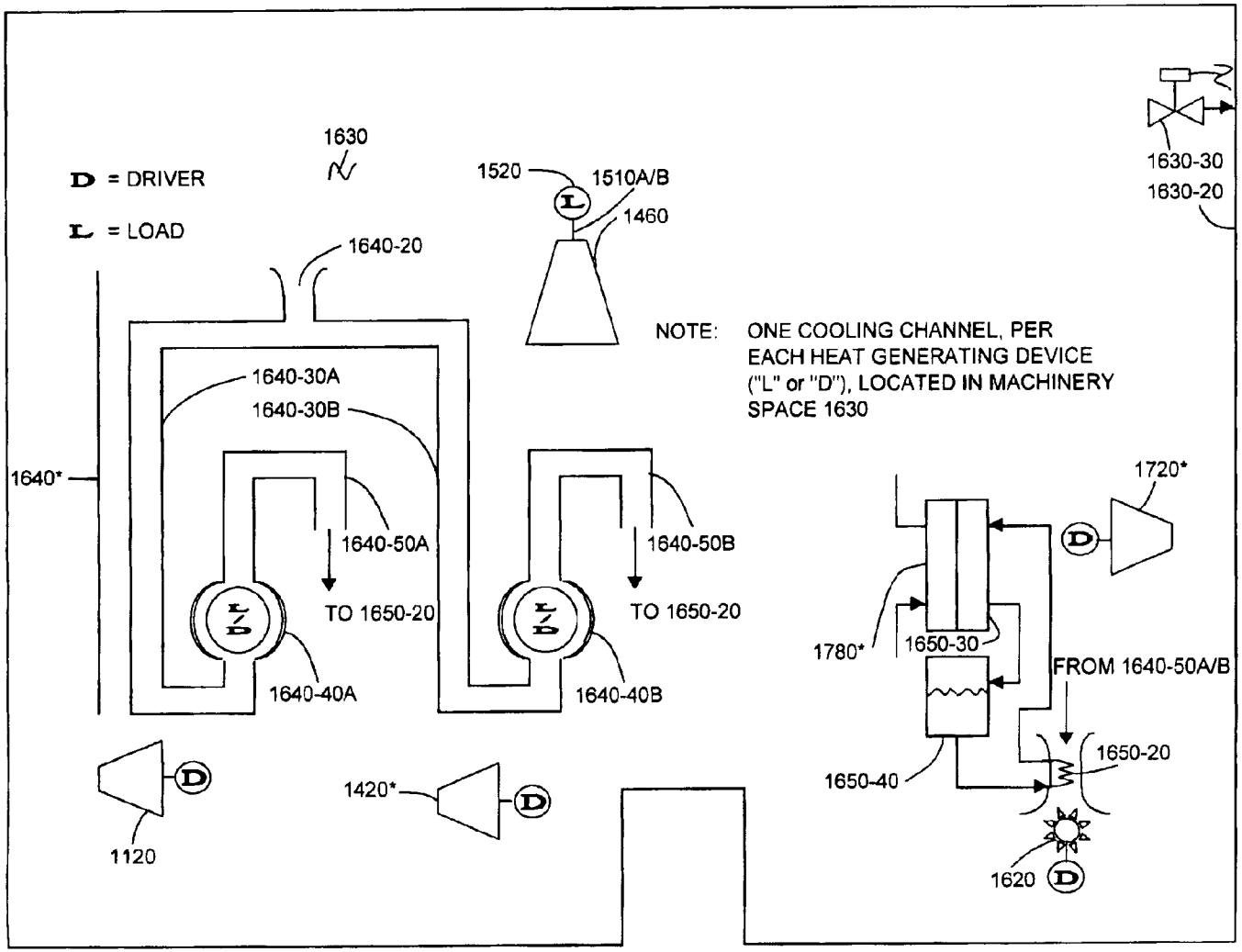

Fig. 1H – Main embodiment, heat source flow circuit of a waste heat recycling thermal power plant.
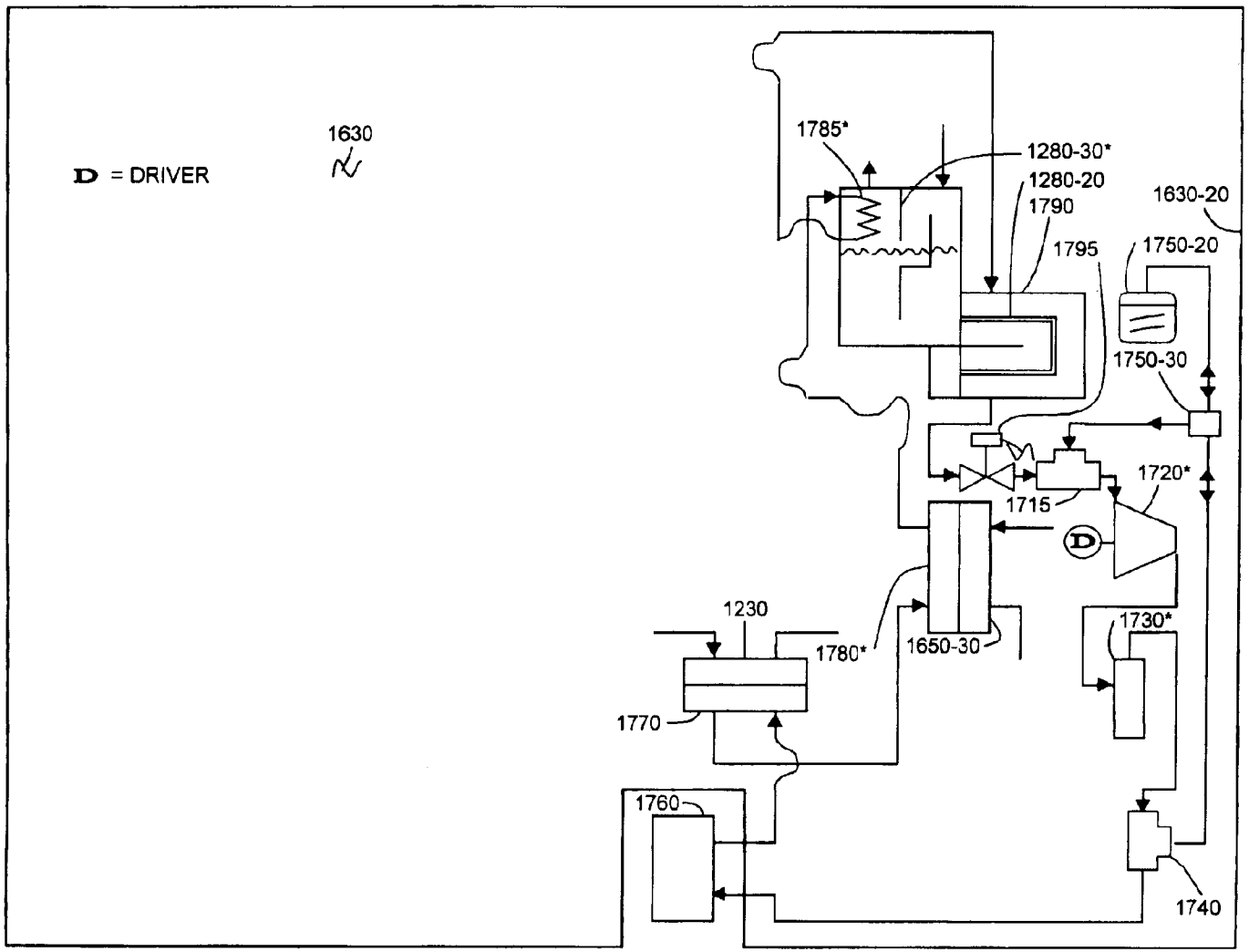

Fig. 2A – Alternative embodiment, a waste heat recycling thermal power plant, with a modified suction flow circuit.
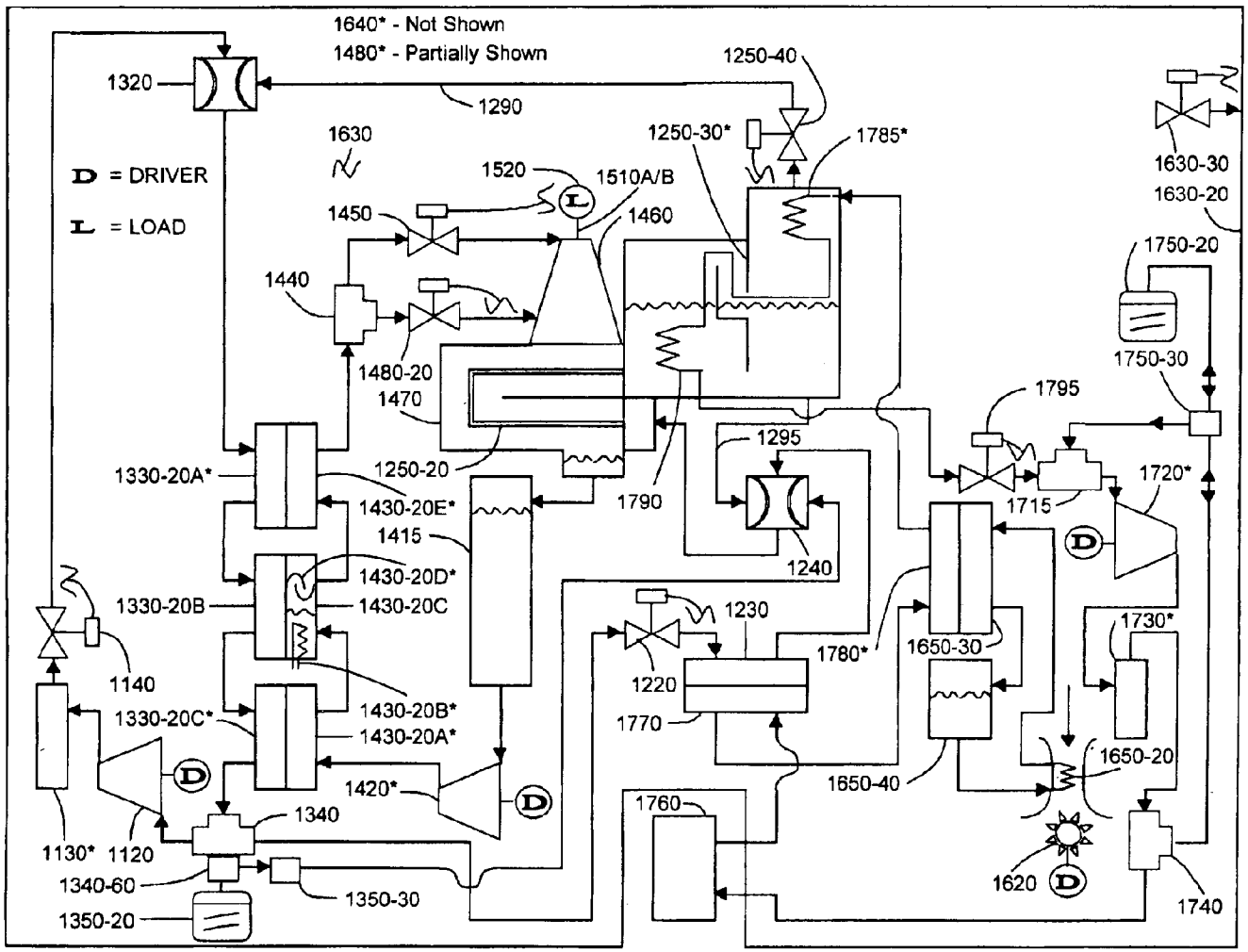

Fig. 2B – Alternative embodiment, suction flow circuit of a waste heat recycling thermal power plant.
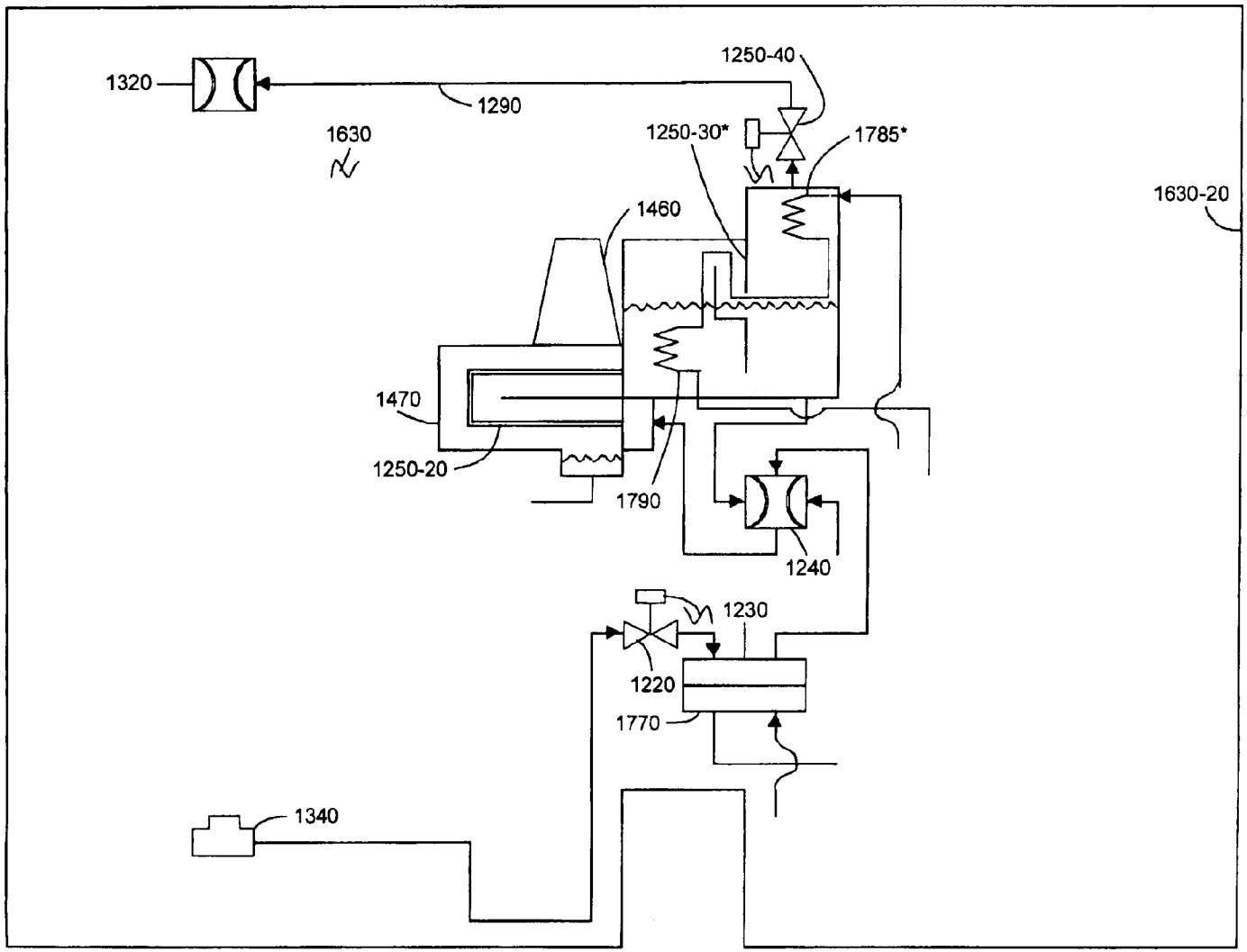

METHOD AND APPARATUS FOR A WASTE HEAT RECYCLING THERMAL POWER PLANT

BACKGROUND OF THE INVENTION

1. Field of the Invention

This invention relates to the field of thermal power plants, specifically of the type that recycle a significant portion of the heat that is normally rejected to the environment by "conventional" thermal power plants.

2. Description of the Prior Art

A search of the prior art reveals numerous inventions that attempt to improve the efficiency of various types (e.g., Rankine cycle, Stirling cycle, Brayton cycle, Otto cycle, Diesel cycle, Seebeck cycle, etc.) of heat engines and the thermal power plants in which they are contained.

In 1824, Nicolas Leonard "Sadi" Carnot, a French engineer and founder of the discipline now known as "Thermodynamics," published his treatise (*Reflexions sur la puissance motrice du feu et sur les machines propres a developper cette puissance*) on the nature of heat engines. The relevant finding of this paper was that all heat engines, in order to function, first receive heat from a "high-temperature" heat source, and then must reject heat (i.e., unused heat, a.k.a. waste heat) to a "low-temperature" heat sink. He also gave us what is now known as the "Carnot Efficiency," which states that the efficiency of a heat engine is improved as the temperature differential between the heat source and the heat sink is increased. In the decades that followed, others expanded upon and clarified our understanding of the nature of heat, and how best to employ it in heat engines. Most notable among them was an engineering professor from Scotland named William J. M. Rankine, who in 1859, published his treatise (*Manual of the Steam Engine and Other Prime Movers*) relating to heat engines, wherein he described what is now known as the "Rankine cycle." Later, still others expanded upon the ideas postulated by Prof Rankine, a process that continues to the present day.

The Rankine cycle itself is inherently inefficient, yet it has attributes, which have caused it to become one of the leading forms of heat engine cycles employed today. First, the Rankine cycle is well understood by the designers and users of power generation equipment. Second, the Rankine cycle lends itself well to the employment of very large and therefore very cost-effective components. Third, with the exception of "hydro-power" nothing can produce electrical power less expensively than a modern electrical power generating station employing a "modified" Rankine cycle.

The latest attempts to improve upon the Rankine cycle employ various forms of "co-generation;" i.e., they attempt to convert a portion of the waste heat rejected by a "host" heat engine into additional electrical power, industrial process heating, and/or air conditioning capacity. The latter two approaches, while beneficial are not very practical, for it is a rare or non-existent industrial process that would require all of the waste heat being liberated by the "host" heat engine. Similarly, the air conditioning capacity approach, while quite ingenious, has two burdens hindering its widespread use, first the "host" heat engine needs to be located near the facility to be cooled, and second, air conditioning is not a "stable" demand (i.e., high demand in the summer, and low demand in the winter). Which leaves the additional electrical power approach as the only economically viable method for improving the efficiency of thermal power plants.

There exists a class of heat engines known as "Bottoming Cycle Heat Engines," many of which include components referred to as "Heat Recovery Steam Generators" or HRSG's. Essentially, their designers have placed a second Rankine cycle heat engine in the waste heat stream of the "host" heat engine, and while it is the "environmentally friendly" thing to do, financially it is not very attractive. This approach is costly and does not provide the kind of returns that most electric utility shareholders are looking for on the bottom line of their financial statements.

One of the principal reasons for the resistance to these devices is that they involve extensive and therefore expensive redesigns of existing facilities; as a result they are not being widely used to rehabilitate older power plants. New facilities, currently under construction, are just now starting to incorporate some of these design elements, yet the larger opportunity is to retrofit the worldwide base of currently operating electrical power generating facilities. To do this, a design approach that accomplishes the following key points must be employed: the design must be environmentally friendly, the design must not require expensive changes to the "host" facility, the design must be reliable, and the design must produce an acceptable financial return. Such a design will meet with success, to date, not a single example of the prior art has satisfied all of these requirements.

BRIEF SUMMARY OF THE INVENTION

1. Overview

In accordance with the present invention a waste heat recycling thermal power plant comprises a multitude of interacting volatile working fluid(s) circuits that generate a thermal potential between itself and an employable external heat source, extracting useable heat from that heat source (to replace the heat converted to mechanical energy or otherwise lost from the system), generating a super-ambient temperature heat source and a sub-ambient temperature heat sink, whose thermal potential is capable of providing a useable heat flow to fuel its incorporated heat engine, recycling collected system thermal losses and much of the useable heat flow that is rejected by its incorporated heat engine to its super-ambient temperature heat source, and the resultant mechanical power output produced by its incorporated heat engine is employed to drive a mechanical load (e.g., gearbox, electrical generator, propeller shaft, etc.).

2. Objects & Advantages

Accordingly, several objects and advantages of the present invention are:

(a) to provide a thermal power plant which can capture and reuse much of the waste heat that its own operation liberates;

(b) to provide a thermal power plant which can extract useable heat from the environment;

(c) to provide a thermal power plant which can extract useable heat from a "low-temperature" external heat source;

(d) to provide a thermal power plant which can extract useable heat utilizing a small thermal potential;

(e) to provide a thermal power plant, which can extract useable heat from the waste heat that is rejected by a "host" heat engine;

(f) to provide a thermal power plant which can create a thermal potential between itself and an employable external heat source;

(g) to provide a thermal power plant which having created a thermal potential between itself and an employable external heat source, can utilize the heat extracted from that external heat source to fuel its own operation;

(h) to provide a thermal power plant which can concentrate the extracted heat to generate a super-ambient temperature heat source to supply a useable heat flow to its incorporated heat engine;

(i) to provide a thermal power plant which can generate a sub-ambient pressure region sufficient to evaporate a portion of its liquid working fluid flow at a sub-ambient temperature, thus creating a sub-ambient temperature heat sink for its incorporated heat engine;

(j) to provide a thermal power plant which can supply a useable heat flow between its super-ambient temperature heat source and its sub-ambient temperature heat sink, sufficient to fuel its incorporated heat engine;

(k) to provide a thermal power plant which can produce mechanical power in excess of its own operational requirements, sufficient to drive an electrical generator;

(l) to provide a thermal power plant which can produce electrical power in excess of its own operational requirements, sufficient to provide electrical power to the local electrical power distribution grid;

(m) to provide a thermal power plant which can improve the thermal efficiency of the "host" heat engine by lowering the temperature of the host's heat sink;

(n) to provide a thermal power plant which can improve the fuel efficiency of the "host" heat engine by allowing the "host" to operate at a lower power level while still meeting the electrical demand;

(o) to provide a thermal power plant which can reduce the amount of chemical pollution released to the environment by allowing the "host" heat engine, or an allied heat engine located elsewhere on the electrical grid, to operate at a lower power level while still meeting the electrical demand; and (p) to provide a thermal power plant which can increase the output capacity of the "host" engine by adding its electrical output to that of the host's electrical output.

Further objects and advantages are to provide: a thermal power plant that is environmentally friendly, one that will not require expensive modifications to the "host" facility, one that will operate reliably over its operational life-span, and one that will produce an acceptable financial return on its owner's investment. Still further objects and advantages will become apparent from a consideration of the ensuing description and drawings.

BRIEF DESCRIPTION OF THE DRAWINGS

FIG. 1A shows the main embodiment of the waste heat recycling thermal power plant 1000.

FIG. 1B shows the motive flow circuit 1100 of the main embodiment of the waste heat recycling thermal power plant 1000.

FIG. 1C shows the suction flow circuit 1200 of the main embodiment of the waste heat recycling thermal power plant 1000.

FIG. 1D shows the conjoined flow circuit 1300 of the main embodiment of the waste heat recycling thermal power plant 1000.

FIG. 1E shows the incorporated heat engine flow circuit 1400 of the main embodiment of the waste heat recycling thermal power plant 1000.

FIG. 1F shows the mechanical output device 1500 of the main embodiment of the waste heat recycling thermal power plant 1000.

FIG. 1G shows the heat recovery flow circuit 1600 of the main embodiment of the waste heat recycling thermal power plant 1000.

FIG. 1H shows the heat source flow circuit 1700 of the main embodiment of the waste heat recycling thermal power plant 1000.

FIG. 2A shows an alternative embodiment of the waste heat recycling thermal power plant 1000 (which details a different arrangement of components within the suction flow circuit).

FIG. 2B shows the suction flow circuit 1200 of an alternative embodiment of the waste heat recycling thermal power plant 1000.

DETAILED DESCRIPTION

1. Main Embodiment—Physical Layout

A waste heat recycling thermal power plant 1000 (FIG. 1A) consists primarily of two conjoined circuits, a motive flow circuit 1100 and a suction flow circuit 1200 of a volatile working fluid (the conjoined portions of motive flow circuit 1100 and suction flow circuit 1200 are identified as a conjoined flow circuit 1300). Additionally, waste heat recycling thermal power plant 1000 includes an incorporated heat engine flow circuit 1400 connected to a mechanical output device 1500, a heat recovery flow circuit 1600 (optional, a heat source flow circuit 1700, and the subcomponents contained therein. These circuits and their subcomponents are described below; the interconnecting piping/ducting is described only where necessary to add clarity to the description.

Motive flow circuit 1100 (FIG. 1B) which originates at a cfd flow separation chamber 1340-30, and successively flows through: a cfd motive flow discharge 1340-40, an mfc fluid transfer device 1120, an mfc fluid filtering device 1130 (optional), an mfc fluid flow-regulating device 1140, and discharges to conjoined flow circuit 1300 via a cfc sub-ambient pressure generating device 1320, which completes the circuit.

Suction flow circuit 1200 (FIG. 1C) which originates at a cfd flow separation chamber 1340-30, and successively flows through: a cfd suction flow discharge 1340-50, an sfc fluid flow-regulating device 1220, an sfc sfc-hsfc heat recycling heat transfer device 1230, an sfc shrd-ssths fluid transfer device 1240 [which contains: an ssftd sfc working fluid inlet 1240-15, an ssftd shrd excess working fluid inlet 1240-20, an ssftd cssd overpressure relief device working fluid inlet 1240-30, an ssftd suction chamber 1240-35, and an ssftd working fluid discharge 1240-40], an sfc sub-ambient temperature heat sink 1250 [which contains: an ssths ihefc-sfc evaporative heat transfer device 1250-20, an ssths liquid/vapor separation device 1250-30 (optional), and an ssths ihefc-sfc evaporative heat transfer device pressure-regulating device 1250-40], an shrd hsfc-sfc evaporative heat transfer device ssths vapor supply device 1260, an shrd hsfc-sfc evaporative heat transfer device liquid supply device 1270, an sfc heat replenishment device 1280 [which contains: an shrd hsfc-sfc evaporative heat transfer device 1280-20, an shrd liquid/vapor separation device 1280-30 (optional), an shrd hsfc-sfc super-heat heat transfer device 1280-40 (optional), and an shrd hsfc-sfc evaporative heat transfer device pressure-regulating device 1280-50], an sfc shrd-cspgd vapor transfer device 1290, an sfc shrd-ssftd excess tertiary liquid component transfer device 1295, and discharges to conjoined flow circuit 1300 via cfc sub-ambient pressure generating device 1320, which completes the circuit.

Conjoined flow circuit 1300 (FIG. 1D) which originates at a cspgd suction chamber 1320-40, and successively flows through: a cspgd conjoined flow discharge 1320-50, a cfc super-ambient temperature heat source 1330 [which contains: a csths super-heat heat transfer device 1330-20A (optional), a csths boiler heating device 1330-20B, and a csths feed-heat heat transfer device 1330-20C (optional)]], a cfc flow divider 1340 [which contains: a cfd conjoined flow inlet 1340-20, a cfd flow separation chamber 1340-30, a cfd motive flow discharge 1340-40, or a cfd suction flow discharge 1340-50, or a cfd fluid import/export device 1340-60], a cfc safety/service device 1350 [which contains: a cssd fluid thermal expansion device 1350-20, a cssd overpressure relief device 1350-30, and a cssd venting/servicing device 1350-40], and discharges to motive flow circuit 1100 and suction flow circuit 1200 via cfc flow divider 1350, which completes the circuit.

Incorporated heat engine flow circuit 1400 (FIG. 1E) which originates at the inlet of an ihefc fluid transfer device 1420 (optional, not required if utilizing gravity-induced circulation), and successively flows through: an ihefc fluid transfer device 1420 (optional), an ihefc super-ambient temperature heat source 1430 [which contains: an isths feed-heat heat transfer device 1430-20A (optional), an isths ihefc starting device 1430-20B (optional), an isths boiler 1430-20C, an isths liquid/vapor separation device 1430-20D (optional), and an isths super-heat heat transfer device 1430-20E (optional)]], an ihefc vapor export device 1440 [which contains: an ived ihefc working fluid inlet 1440-20, an ived flow separation chamber 1440-30, an ived overpressure relief device working fluid discharge 1440-40, and an ived ipedlc working fluid discharge 1440-50], an ihefc fluid flow-regulating device 1450, an ihefe pressure expansion device 1460 (e.g., Rankine cycle vapor turbine), an ihefc sub-ambient temperature heat sink 1470 [which contains: an isths ihefc-sfc condensing heat transfer device 1470-20, and an isths venting/servicing device 1470-30], and an ihefc fluid storage device 1415, which completes the circuit.

An ihefc pressure expansion device lubrication circuit 1480 (optional) augments the incorporated heat engine flow circuit 1400. Ihefc pressure expansion device lubrication circuit 1480 [optional, which contains: an ipedlc pressure-regulating device 1480-20, an ipedlc vapor bearing device 1480-30, and an ipedlc vapor flow-regulating device 1480-40], bypasses around the ihefc fluid flow-regulating device 1450 and the ihefc pressure expansion device 1460, via an ihefc vapor export device 1440 and an ihefc fluid return device 1490 [which contains: an ifrd ihefc overpressure relief device working fluid inlet 1490-20, an ifrd ipedlc working fluid inlet 1490-30, an ifrd flow collecting chamber 1490-40, and an ifrd isths ihefc-sfc condensing heat transfer device working fluid discharge 1490-50]. In addition, an ihefc overpressure relief device 1485 is interposed between the ihefc vapor export device 1440 and the ihefc fluid return device 1490.

Mechanical output device 1500 (FIG. 1F) is connected to incorporated heat engine flow circuit 1400. Specifically, a mod driven mechanical device 1520 (e.g., gearbox, generator, propeller shaft, etc.) is connected to incorporated heat engine flow circuit 1400's ihefc pressure expansion device 1460 via a mod hermetic power coupling device 1510A (omit if 1510B is utilized) or a mod intermediate drive shaft with shaft sealing device 1510B (omit if 1510A is utilized), which completes the device.

Heat recovery flow circuit 1600 (optional, FIG. 1G) originates at the inlet of an hrfc ventilation motive device 1620, and successively flows through: an hrfc ventilation motive device 1620, an hrfc machinery space 1630 [which contains: an hms exposed surfaces 1630-20 (i.e., floor, walls, ceiling, equipment, piping, etc.), and an hms overpressure relief device 1630-30 (discharges to the environment)], an hms cooling distribution device 1640 [optional which includes: an hcdd working fluid inlet 1640-20, an hcdd distribution device 1640-30(x) (one channel for each unit that requires cooling, "x"—the designation changes for each unit), an hcdd cooled machinery unit 1640-40(x) ("x"—the designation changes for each unit), and an hcdd cooling exhaust collection device 164650(x) ("x"—designation changes for each unit)], an hrfc heat recycling heat transfer device 1650 [which contains: an hhrhtd hrfc-hsfc heat recycling evaporative heat transfer device 1650-20, and an hhrhtd hrfc-sfc heat recycling condensing heat transfer device 1650-30, and an hhrhtd working fluid storage device 1650-40], which completes the circuit.

Heat source flow circuit 1700 (FIG. 1H) originates at the inlet of an hsfc fluid transfer device 1720 (optional, not required if utilizing gravity-induced circulation), and successively flows through: an hsfc fluid transfer device 1720 (optional), an hsfc fluid filtering device 1730 (optional), an hsfc fluid import/export device 1740, an hsfc safety/service device 1750 [which contains: an hssm fluid thermal expansion device 1750-20, an hssm overpressure relief device 1750-30, and an hssm venting/servicing device 1750-40], an hsfc heat source heat transfer device 1760, an hsfc sfc-hsfc heat recycling heat transfer device 1770, an hsfc hrfc-hsfc heat recycling heat transfer device 1780, an hsfc hsfc-sfc super-heat heat transfer device 1785 (optional), an hsfc hsfc-sfc evaporative heat transfer device 1790, an hsfc hsfc-sfc heat transfer device working fluid discharge temperature-regulating device 1795, and an hsfc fluid return device 1715, which completes the circuit.

In additions the circuits are constructed of materials suitable for containing the working fluid in each circuit (i.e., chemically compatible, and capable of withstanding the operating conditions imposed by the operation of waste heat recycling thermal power plant 1000).

Note: Other types of heat engines may be utilized in lieu of the example Rankine cycle vapor turbine unit described above (e.g., Stirling cycle engine, Seebeck cycle thermoelectric generator, etc.). Any heat engine, which is capable of employing the developed temperature differential, may be interposed between cfc super-ambient temperature heat source 1330 and sfc sub-ambient temperature heat sink 1250. Depending upon the characteristics of the alternative heat engine, and the working fluid(s) utilized, configuration changes may be required (i.e., the routing of conjoined flow circuit 1300 through cfc super-ambient temperature heat source 1330 and suction flow circuit 1200 through sfc sub-ambient heat sink 1250 may need to be altered). In the forgoing, "ambient" refers to the conditions (in terms of absolute pressure and absolute temperature) at cfd flow separation chamber 1340-30, this reference point (a.k.a., an ambient conditions datum), depending upon the characteristics of the working fluid utilized in conjoined flow circuit 1300, could differ substantially from standard atmospheric conditions (i.e., 14.696 psia and 536.67 deg-R).

2. Main Embodiment—Operation

Every heat engine requires a source of heat to operate, typically it is a hydrocarbon-based fuel that is burned in order to release the energy stored in the substance's interatomic chemical bonds. Depending upon the type of heat engine in question, it is normal for a large portion of the heat provided to such engines to be rejected to the environment (i.e., wasted, having performed no useful work). This has been the state of the art since the first recorded example of a heat engine (in the first century AD, Hero of Alexandria, Egypt is said to have described his Aeolipile, a rudimentary steam turbine). To be sure, the state of the art has improved much over the intervening centuries, yet it remains an unbreakable rule (i.e., the Second Law of Thermodynamics) that all heat engines must reject heat in order to function, and waste heat recycling thermal power plant 1000 is no different in this regard. What is different is the proportion of heat rejected, and the methodology employed to conserve and reuse much of the heat that is rejected in a typical heat engine.

Waste heat recycling thermal power plant 1000 (FIG. 1A) utilizes the interaction of motive flow circuit 1100, suction flow circuit 1200, conjoined flow circuit 1300, incorporated heat engine flow circuit 1400, mechanical output device 1500, heat recovery flow circuit 1600 (optional), and heat source flow circuit 1700 to capture and reuse much of the waste heat that its own operation liberates. What follows is an examination of those interactions.

Heat source flow circuit 1700 (FIG. 1H) performs four essential functions in the operation of waste heat recycling thermal power plant 1000. First, it acquires replenishment heat (i.e., replacing the heat that is converted to mechanical energy or lost from the system) from the external heat source(s) (e.g., geothermal pool, solar collector, river, industrial process cooling water, etc.) via hsfc heat source heat transfer device 1760. Second, it receives recyclable heat (i.e., heat that is wasted in a typical heat engine) from suction flow circuit 1200 via hsfc sfc-hsfc heat recycling heat transfer device 1770, and the heat recovery flow circuit 1600 (optional) via hfsc hrfc-hsfc heat recycling heat transfer device 1780 (optional). Third, it transports this heat (replenishment and recycled) to hsfc hfsc-sfc super-heat heat transfer device 1785 (optional) and hsfc hfsc-sfc evaporative heat transfer device 1790. Fourth, it provides "chilled" working fluid to hsfc heat source heat transfer device 1760.

The working fluid in heat source flow circuit 1700 is motivated by hsfc fluid transfer device 1720 (optional, not required if utilizing gravity-induced circulation), filtered by hsfc fluid filtering device 1730 (optional), and its flow is controlled by hsfc hsfc-sfc evaporative heat transfer device working fluid discharge temperature-regulating device 1795. This last element acts to increase the flow of hsfc working fluid 1710 in heat source flow circuit 1700 when hsfc hsfc-sfc evaporative heat transfer device 1790 discharge temperature decreases below the desired operating point, conversely it acts to decrease hsfc working fluid 1710 flow when the discharge temperature rises above the desired operating point (the desired operating point is user adjustable).

The remaining enumerated subcomponents of heat source flow circuit 1700 serve to protect the circuit itself from the hydraulic hazards associated with fluids in confined spaces (i.e., thermal expansion, and over-pressurization), as well as providing a way to add/remove working fluid to/from the circuit.

Heat recovery flow circuit 1600 (optional, FIG. 1G, omit if 1780 is not utilized) performs four essential functions in the operation of waste heat recycling thermal power plant 1000. First, it receives recyclable heat from the heat liberating machinery units (e.g., gearbox, electric generator, electric motor(s), etc.) in hrfc machinery space 1630. Second, it receives recyclable heat lost from hotter portions of the system [i.e., system heat lost to the surrounding environment by hms exposed surfaces 1630-20 (i.e., floor, walls, ceiling, equipment, piping, etc.), in this case the heat is "lost" to hrfc machinery space 1630]. Note: heat lost by hrfc machinery space 1630 to the environment is non-recoverable; however, this loss may be minimized and/or partially offset by passive solar gain during the warmest portions of the year. Third, it transports this recycled heat to hsfc hrfc-hsfc heat recycling heat transfer device 1780 (optional) via hrfc heat recycling heat transfer device 1650. Fourth, it provides "chilled" working fluid to hcdd working fluid inlet 1640-20.

The working fluid in heat recovery flow circuit 1600 is motivated by gravity-induced circulation; further, this circulation is augmented with hrfc ventilation motive device 1620, and the flow of hrfc working fluid 1610 is controlled by the operation of the previous element. Hrfc ventilation device 1620 is operated at maximum output to increase the flow of hrfc working fluid 1610 in order to reduce the temperature in hrfc machinery space 1630, minimum output is utilized to decrease the flow and increase the temperature to the desired level, intermediate output levels are utilized to maintain the temperature at the desired level, once that temperature is attained (the desired operating point is user adjustable).

As heated gas tends to rise, hcdd working fluid inlet 1640-20 is located near the ceiling of hrfc machinery space 1630 from there hms working fluid 1640-10 is conducted via hms cooling distribution device 1640 [optional, which contains: an hcdd working fluid inlet 1640-20, hcdd distribution device 1640-30(x) (one channel for each heat generating device, "x"—designation changes for each unit) conducts hms working fluid 1640-10 to hcdd cooled machinery unit 1640-40(x) ("x"—designation changes for each unit) where it receives recyclable heat liberated by the operation of the cooled machinery unit, next hcdd machinery cooling exhaust collection device 1640-50(x) ("x" designation changes for each unit) conducts the heated hms working fluid 1640-10 via chimney effect to hrfc heat recycling heat transfer device 1650]. The collected heat conducted to hrfc heat recycling device 1650 is transported to hsfc hrfc-hsfc heat recycling heat transfer device 1780 (optional) via hhrhtd hrfc-hsfc heat recycling evaporative heat transfer device 1650-20, and an hhrhtd hrfc-hsfc heat recycling condensing heat transfer device 1650-30. Note: were a single operating point possible, this interconnection could be achieved more efficiently with a liquid-to-liquid heat transfer device; however, that type of operating environment is unlikely, and this evaporative/condensing interface provides a self-adjusting heat transfer device (i.e., the evaporative temperature will rise/fall on its own until the rate of evaporation is equal to the rate of condensation, and a new heat transfer equilibrium is established).

In addition, hrfc machinery space 1630 is protected from over-pressurization damage by hms overpressure relief device 1630-30 (discharges to the environment), such damage is possible in the event of a catastrophic loss of working fluid containment and the resultant flashing of the working fluid to vapor, although the working fluid temperatures and pressures envisioned make this an extremely remote possibility.

Suction flow circuit 1200 (FIG. 1C) performs seven essential functions in the operation of waste heat recycling thermal power plant 1000. First, it provides recyclable heat to heat source flow circuit 1700 via sfc sfc-hsfc heat recycling heat transfer device 1230. Second, it utilizes residual sfc working fluid 1210 pressure to operate sfc shrd-ssths fluid transfer device 1240, this element draws excess working fluid from shrd hsfc-sfc evaporative heat transfer device 1280-20 and along with sfc working fluid 1210 supplied via sfc sfc-hsfc heat recycling heat transfer device 1230 combines to provide vigorous circulation within the heat transfer passages of sfc sub-ambient temperature heat sink 1250, and sfc heat replenishment device 1280. Third, it receives recyclable heat (i.e., waste heat in a typical heat engine) from sfc sub-ambient temperature heat sink 1250, this occurs specifically in ssths ihefc-sfc evaporative heat transfer device 1250-20, where much of ssths working fluid 1250-10 admitted is converted to vapor. The portion of ssths working fluid 1250-10 that remains in liquid form is transported to sfc heat replenishment device 1280 via shrd hsfc-sfc evaporative heat transfer device ssths liquid supply device 1270. The portion of ssths working fluid 1250-10 that is converted to vapor is transported to sfc heat replenishment device 1280 via shrd hsfc-sfc evaporative heat transfer device ssths vapor supply device 1260, where it combines with the vapor formed in shrd hsfc-sfc evaporative heat transfer device 1280-20, then through ssths liquid/vapor separation device 1250-30 (optional), ssths ihefc-sfc evaporative heat transfer device pressure-regulating device 1250-40. Fourth, it receives replenishment heat (i.e., replacing the heat converted to mechanical energy or lost from the system) from heat source flow circuit 1700 via shrd hsfc-sfc evaporative heat transfer device 1280-20 and shrd hsfc-sfc super-heat heat transfer device 1280-40 (optional). Fifth, it transports super-heated vapor to cfc sub-ambient pressure generating device 1320 via shrd liquid/vapor separation device 1280-30 (optional), shrd hsfc-sfc super-heat heat transfer device 1280-40 (optional), shrd hsfc-sfc evaporative heat transfer device pressure-regulating device 1280-50, and sfc shrd-cspgd vapor transfer device 1290. Sixth, it provides the heat (i.e., latent heat of vaporization and super-heat contained within the super-heated vapor) required to increase the temperature of mfc working fluid 1110 to that observed at the discharge of cfc sub-ambient pressure generating device 1320. Seventh, it provides working fluid to conjoined flow circuit 1300.

Sfc working fluid 1210 flow is motivated by the pressure differential between cfd flow separation chamber 1340-30 and cspgd suction chamber 1320-40, and its flow is controlled by sfc fluid flow-regulating device 1220. Note: by producing a region of sub-ambient pressure, cfc sub-ambient pressure generating device 1320 enables the pressure-regulating devices (1250-40 & 1280-50) to regulate the pressure of their respective evaporative heat transfer devices (1250-20 & 1280-20) by controlling the flow of working fluid vapor flow that exits their respective evaporative heat transfer device. This has an added benefit to the operation of waste heat recycling thermal power plant 1000; precision regulation of these evaporating pressures also produces precise control of the temperatures within the respective evaporative heat transfer device (1250-20 & 1280-20).

Motive flow circuit 1100 (FIG. 1B) performs four essential functions in the operation of waste heat recycling thermal power plant 1000. First, it produces the pressure differential that is responsible for motivating all working fluid flow in motive flow circuit 1100, suction flow circuit 1200, and conjoined flow circuit 1300. Second, it filters (if so configured) all the working fluids in those same circuits. Third, it provides the high-pressure working fluid to cfc sub-ambient pressure generating device 1320 that is required to generate a region of sub-ambient pressure in cspgd suction chamber 1320-40. Fourth, it provides working fluid to conjoined flow circuit 1300.

Mfc working fluid 1110 is motivated by mfc fluid transfer device 1120, is filtered by mfc fluid filtering device 1130 (optional), and its flow is controlled by mfc fluid flow-regulating device 1140. The previous element acts to decrease mfc working fluid 1110 flow, when the flow exceeds the desired operating point, and conversely it acts to increase the flow, when the flow is below the desired operating point (the desired operating point is user adjustable).

Conjoined flow circuit 1300 (FIG. 1D) performs four essential functions in the operation of waste heat recycling thermal power plant 1000. First, it receives high-pressure liquid from motive flow circuit 1100 and super-heated vapor from suction flow circuit 1200, and combines these flows to produce the high temperature liquid working fluid flow discharged from cfc sub-ambient pressure generating device 1320. Second, it transports this thermal energy-rich liquid working fluid flow to cfc super-ambient temperature heat source 1330 where it supplies heat to ihefc super-ambient temperature heat source 1430. Third, it provides working fluid to motive flow circuit 1100 and suction flow circuit 1200. Fourth, via cssd thermal expansion device 1350-20 it is possible to adjust the "ambient" pressure experienced at cfd flow separation chamber 1340-30.

Cfc working fluid 1310 flow is motivated by the pressure differential between cspgd conjoined flow discharge 1320-50 and cfd flow separation chamber 1340-30, and is controlled by the resistance to flow inherent in the same circuit (i.e., depending upon configuration, multiple indirect heat transfer devices impede the flow of the working fluid). Note: the pressure differential generated between 1320-50 & 1340-30 will rise/fall on its own until the rate at which working fluid leaves the conjoined flow circuit 1300 is equal to the rate at which working fluid enters the same circuit, thus establishing a new mass transfer equilibrium.

Cssd overpressure relief device 1350-30 is interposed between cfd flow separation chamber 1340-30 and ssftd cssd overpressure relief device working fluid inlet 1240-30, in the event of an overpressure condition this element would allow excess working fluid to be routed to ssths ihefc-sfc evaporative heat transfer device 1250-20, which has a surge capacity. Cssd venting/servicing device 1350-40 allows for adding/removing working fluid to/from conjoined flow circuit 1300.

Incorporated heat engine flow circuit 1400 (FIG. 1E) performs six essential functions in the operation of waste heat recycling thermal power plant 1000. First, it receives heat from conjoined flow circuit 1300 via ihefc super-ambient temperature heat source 1430. Second, it transports this heat to ihefc pressure expansion device 1460 via ihefc fluid flow-regulating device 1450. Third, it produces mechanical power by pressure expanding ihefc working fluid 1410 in ihefc pressure expansion device 1460 (e.g., Rankine cycle vapor turbine). Fourth, it rejects recyclable heat to suction flow circuit 1200 via ihefc sub-ambient temperature heat sink 1470. Fifth, it provides a hermetic circuit to lubricate ihefc pressure expansion device 1460 via ihefc pressure expansion device lubricating circuit 1480 (optional). Sixth, it provides working fluid to ihefc super-ambient heat source 1430 [this function can be accomplished utilizing gravity-induced circulation, augmented with or supplanted by, ihefc fluid transfer device 1420 (optional)].

The remaining enumerated subcomponents of incorporated heat engine flow circuit 1400 serve to protect the circuit itself from the hydraulic hazards associated with fluids in confined spaces (i.e., thermal expansion, and over-pressurization), as well as providing a device to add/remove working fluid to/from the circuit.

Mechanical output device 1500 (FIG. 1F) performs four essential functions in the operation of waste heat recycling thermal power plant 1000. First, it receives the mechanical power produced by ihefc pressure expansion device 1460. Second, it transmits this mechanical power to hrfc machinery space 1630 via mod hermetic power coupling 1510A or mod intermediate drive shaft with shaft sealing device 1510B. Third, it provides mechanical power to mod driven mechanical device 1520 (e.g., gearbox, generator, propeller shaft, etc.). Fourth, it provides recyclable heat to heat recovery flow circuit 1600 via hrfc heat recycling heat transfer device 1650.

To review, the operation of waste heat recycling thermal power plant 1000 (FIG. 1A), requires heat source flow circuit 1700 to acquire and transport replenishment heat in sufficient quantity to replace all of the heat that is converted to mechanical energy or lost from the system. This heat is then transferred to suction flow circuit 1200 where it completes the evaporation of sfc working fluid 1210 flow, and super-heats the entire shrd hsfc-sfc evaporative heat transfer device pressure-regulating device 1280-50 inlet flow (i.e., all of the liquid working fluid provided to suction flow circuit 1200 from conjoined flow circuit 1300 is returned to conjoined flow circuit 1300 from suction flow circuit 1200 in the form of super-heated vapor). This super-heated vapor then combines with liquid from motive flow circuit 1100 in cfc sub-ambient pressure generating device 1320 to produce a thermal energy-rich liquid working fluid flow which is provided to cfc super-ambient temperature heat source 1330. This heat is then supplied to ihefc flow circuit 1400 where a portion of it is converted to mechanical power by ihefc pressure expansion device 1460. This mechanical power is then transmitted via mechanical output device 1500 to mod driven mechanical device 1520 (e.g., gearbox, generator, propeller shaft, etc.) to drive a mechanical load. Wherever feasible, waste heat recycling thermal power plant 1000, captures and reuses substantial portions of the waste heat that its own operation liberates, in particular the heat rejected to sfc sub-ambient temperature heat sink 1250 by incorporated heat engine flow circuit 1400, thus lowering its net energy utilization per unit of mechanical power produced.

3. Alternative Embodiments—Physical Layout & Operation

The basic embodiment of the waste heat recycling thermal power plant 1000 is similar to the main embodiment, the differences being that none of the optional components installed in the main embodiment are utilized in the basic embodiment. The operation of the basic embodiment is also similar to that of the main embodiment; however, the functions performed by the optional components installed in the main embodiment are not performed at all, or not performed as well in the basic embodiment.

One alternative embodiment of the waste heat recycling thermal power plant 1000 utilizes a reconfigured suction flow circuit (FIG. 2A). This approach combines most of the functions that are performed by sfc sub-ambient temperature heat sink 1250 and sfc heat replenishment device 1280 of the main embodiment (FIG. 1C) into a single device (FIG. 2B). Further, it eliminates one evaporation process and the need for a device to control that process' evaporation pressure. The operation of the alternative embodiment is also similar to that of the main embodiment; however, its reconfigured suction flow circuit 1200 can produce a colder heat sink temperature than that of the main embodiment. This alternative embodiment has much to recommend its adoption over that of the main embodiment.

Other alternative embodiments involve: rerouting the flow of the ihefc fluid flow-regulating device 1450 discharge to acquire additional super-heat by cooling the mod driven mechanical device 1520, or rerouting the mfc fluid flow-regulating device 1140 discharge to acquire additional sensible heat by cooling the mod driven mechanical device 1520, and still others involve various methods for evaporating the working fluid and/or the use of various combinations of working fluids.

4. Conclusion, Ramifications, and Scope

Accordingly, the reader will see that the waste heat recycling thermal power plant of this invention can be used to convert the heat contained in a thermal reservoir or a thermal stream to mechanical power, and thereby drive a mechanical load. In addition, the waste heat recycling that occurs within the invention itself enables the waste heat recycling thermal power plant to produce useable mechanical power at "high" net operating efficiencies, even while extracting replenishment heat from "low-temperature" external heat sources. Furthermore, the waste heat recycling thermal power plant has these additional advantages in that it permits the production of mechanical power without burning hydrocarbon-based fuel, thus eliminating the attendant release of "greenhouse" gases;

it permits the production of mechanical power with minimal modifications and/or adaptation expenses to a "host" facility;

it permits the production of mechanical power reliably, through its utilization of robust sub-components;

it permits the production of mechanical power without the need to purchase additional fuel, thus improving the fuel efficiency of the "host" facility;

it permits the production of mechanical power by extracting replenishment heat directly from the environment.

Although the description above contains many specificities, these should not be construed as limiting the scope of the invention but merely providing illustrations of some of the presently preferred embodiments of this invention. For example, the external heat source can take many forms, such as: an industrial process' cooling fluid, a geothermal pool, a solar collector, an internal combustion engine's coolant and/or its exhaust, a sufficiently large body of liquid water (e.g., a lake, or an ocean), etc.

Thus the scope of the invention should be determined by the appended claims and their legal equivalents, rather than by the examples given.

We claim:

1. A method for converting heat to useable mechanical energy and/or electrical energy by continuously and concurrently generating a super-ambient temperature heat source and a sub-ambient temperature heat sink, whose temperature differential is sufficient to develop and sustain a heat flow capable of fueling the operation of an incorporated heat engine, within a thermal power plant, one which recycles much of its own waste heat, without utilizing an external heat sink, also said sub-ambient temperature heat sink captures for reuse much of the waste heat rejected by said incorporated heat engine, further said sub-ambient temperature heat sink has a temperature sufficiently low enough to extract replenishment heat from an external environmental heat source, or sources, sufficient to fuel the operation of said thermal power plant, comprising the steps of:

a. flowing in a conjoined flow circuit, a volatile, sub-cooled, ambient temperature, ambient pressure, liquid stream of a cfc working fluid, separates within a cfc flow divider, into two unequal streams, while passing through an ambient conditions datum, at a point common to said conjoined flow circuit, a motive flow circuit, a suction flow circuit, and a cfd fluid import/export device which provides fluid communication between said conjoined flow circuit and a cfc safety/service device, which is interposed between said cfd fluid import/export device and an sfc shrd-sstths fluid transfer device;

b. leading a greater stream of said two unequal streams leaving said cfc flow divider to an mfc fluid transfer device in said motive flow circuit;

c. pressurizing, at substantially constant entropy, said greater stream has both its pressure and temperature elevated to super-ambient values, thus increasing the specific enthalpy of an mfc working fluid of said greater stream;

d. leading said greater stream leaving said mfc fluid transfer device to an mfc fluid filtering device;

e. filtering, said greater stream has suspended particulate matter removed as it flows through said mfc fluid filtering device;

f. leading said greater stream leaving said mfc fluid filtering device to an mfc fluid flow-regulating device;

g. regulating the flow of said greater stream, said mfc fluid flow-regulating device automatically acts to maintain an adjustable, substantially constant fluid flow, within said motive flow circuit;

h. leading said greater stream leaving said mfc fluid flow-regulating device to a cfc sub-ambient pressure generating device within said conjoined flow circuit;

i. entering said cfc sub-ambient pressure generating device via a cspgd motive flow inlet;

j. leading said greater stream leaving said cspgd motive flow inlet to a cspgd conjoined flow discharge, in so doing said greater stream will expand, at substantially constant entropy, decreasing its pressure energy or head and/or specific enthalpy, and utilizing the pressure energy and/or specific enthalpy given up by said greater stream, to lead the vapor of said lesser stream, supplied via a cspgd suction flow inlet to said cfc conjoined flow discharge, and consequently, to increase the pressure energy or head of the vapor of said lesser stream, by compressing said lesser stream, at substantially constant entropy, such that the sub-ambient pressure vapor supplied by said lesser stream condenses, thoroughly mixing together with said greater stream, distributing much of said lesser stream's latent heat of vaporization to said greater stream, to form a super-ambient pressure, super-ambient temperature liquid, or low quality saturated mixture, thus said cfc sub-ambient pressure generating device combines an mfc working fluid liquid flow with an sfc working fluid vapor flow to produce a cfc working fluid liquid flow, or low quality saturated mixture flow, heated effluent;

k. leading said cfc working fluid liquid flow, or low quality saturated mixture flow, heated effluent leaving said cspgd conjoined flow discharge to a cfc super-ambient temperature heat source;

l. flowing within said cfc super-ambient temperature heat source, said cfc working fluid liquid flow, or low quality saturated mixture flow, heated effluent supplies heat to an incorporated heat engine flow circuit, via one, or more, indirect heat transfer devices, substantially cooling the working fluid, while simultaneously, decreasing its pressure, at substantially constant entropy;

m. leading the substantially cooled, ambient temperature liquid of said cfc working fluid leaving said cfc super-ambient temperature heat source to said cfc flow divider, thus said cfc working fluid is returned to said ambient conditions datum;

n. leading a lesser stream of said two unequal streams leaving said cfc flow divider to an sfc fluid flow-regulating device;

o. regulating the flow of said lesser stream, said sfc fluid flow-regulating device automatically acts to maintain an adjustable, substantially constant fluid flow, within said suction flow circuit;

p. leading said lesser stream leaving said sfc fluid flow-regulating device to an sfc sfc-hsfc heat recycling heat transfer device;

q. flowing through said sfc sfc-hsfc heat recycling heat transfer device, said lesser stream rejects excess sensible heat to a heat source flow circuit, thus lowering the temperature of an sfc working fluid, while simultaneously, decreasing its pressure, at substantially constant entropy;

r. leading said lesser stream leaving said sfc sfc-hsfc heat recycling heat transfer device to said sfc shrd-sstths fluid transfer device;

s. entering said sfc shrd-sstths fluid transfer device via an ssftd sfc working fluid inlet;

t. leading said lesser stream leaving said ssftd sfc working fluid inlet to an ssftd working fluid discharge, in so doing said lesser stream will expand, at substantially constant entropy, decreasing its pressure energy or head and/or specific enthalpy, and utilizing the pressure energy and/or specific enthalpy given up by said lesser stream, to lead the excess liquid of an shrd working fluid, supplied via an ssftd shrd excess working fluid inlet to said ssftd working fluid discharge, and consequently, to increase the pressure energy or head of said shrd working fluid, by pressurizing said shrd working fluid, at substantially constant entropy, such that the sub-ambient pressure liquid, supplied by said ssftd shrd excess working fluid inlet, thoroughly mixes together with said lesser stream, to form a sub-ambient pressure, sub-ambient temperature, low quality saturated mixture, marginally above the freezing point of an ssftd working fluid discharged from said ssftd working fluid discharge, thus said sfc shrd-sstths fluid transfer device combines an sfc working fluid liquid flow with an shrd excess working fluid liquid flow to produce a secondary saturated mixture;

u. leading said secondary saturated mixture leaving said ssftd working fluid discharge to an sfc sub-ambient temperature heat sink;

v. flowing within said sfc sub-ambient temperature heat sink, said secondary saturated mixture, absorbs heat from said incorporated heat engine flow circuit, at substantially constant temperature, via one, or more, indirect heat transfer devices, and as it does so the quality of said secondary saturated mixture increases;

w. exiting the heat exchange passages of said ssths ihefc-sfc evaporative heat transfer device of said sfc sub-ambient temperature heat sink, said secondary saturated mixture separates into a secondary vapor component and a secondary liquid component;

x. leading said secondary vapor component leaving said ssths ihefc-sfc evaporative heat transfer device to an ssths ihefc-sfc evaporative heat transfer device pressure-regulating device;

y. regulating the internal pressure of said ssths ihefc-sfc evaporative heat transfer device, said ssths ihefc-sfc evaporative heat transfer device pressure-regulating device automatically acts to maintain an adjustable, substantially constant pressure, which also effectively maintains the internal temperature, at a substantially constant, sub-ambient value;

z. leading said secondary vapor component leaving said ssths ihefc-sfc evaporative heat transfer device pressure-regulating device to an sfc heat replenishment device;

aa. leading said secondary liquid component leaving said ssths ihefc-sfc evaporative heat transfer device to said sfc heat replenishment device;

ab. flowing within an shrd hsfc-sfc evaporative heat transfer device of said sfc heat replenishment device, the sub-ambient temperature, sub-ambient pressure, saturated liquid of said secondary liquid component, discharged from said sfc sub-ambient temperature heat sink, absorbs heat from said heat source flow circuit, at a substantially constant temperature, via one, or more, indirect heat transfer devices, and as it does so, a portion of said secondary liquid component evaporates, thus producing a tertiary saturated mixture;

ac. exiting the heat exchange passages of said shrd hsfc-sfc evaporative heat transfer device of said sfc heat replenishment device, said tertiary saturated mixture, separates to produce a tertiary vapor component and a tertiary liquid component;

ad. leading the excess liquid of said tertiary liquid component leaving said sfc heat replenishment device to said sfc shrd-ssths fluid transfer device;

ae. entering said sfc shrd-ssths fluid transfer device via an ssftd shrd excess working fluid inlet;

af. combining at the discharge of said shrd hsfc-sfc evaporative heat transfer device of said sfc heat replenishment device, said secondary vapor component and said tertiary vapor component, thoroughly mix together, to produce a homogeneous vapor, thus reforming said lesser stream, as a sub-ambient pressure vapor, marginally above the saturation temperature for the internal pressure of the heat transfer device;

ag. leading said homogenous vapor leaving said shrd hsfc-sfc evaporative heat transfer device to an shrd hsfc-sfc super-heat heat transfer device;

ah. flowing through said shrd hsfc-sfc super-heat heat transfer device, said homogeneous vapor, absorbs heat from said heat source flow circuit, via one, or more indirect heat transfer devices, and as it does so the temperature of said homogeneous vapor increases;

ai. leading said homogenous vapor leaving said shrd hsfc-sfc super-heat heat transfer device to a shrd hsfc-sfc evaporative heat transfer device pressure-regulating device;

aj. regulating the internal pressure of said shrd hsfc-sfc evaporative heat transfer device, said shrd hsfc-sfc evaporative heat transfer device pressure-regulating device automatically acts to maintain an adjustable, substantially constant pressure, which also effectively maintains the internal temperature, at a substantially constant, sub-ambient value;

ak. leading the super-heated vapor of said homogeneous vapor leaving said shrd hsfc-sfc evaporative heat transfer device pressure-regulating device to said cfc sub-ambient pressure generating device;

al. entering said cfc sub-ambient pressure generating device via said cspgd suction flow inlet, to supply working fluid in vapor form, to said cfc sub-ambient pressure generating device, thus reuniting said greater stream with said lesser stream;

am. interposing said cfc super-ambient temperature heat source and said sfc sub-ambient temperature heat sink, said incorporated heat engine flow circuit receives a sustained heat flow from the heat source, driven by the temperature differential between the heat source and the heat sink;

an. converting a portion of said sustained heat flow, by utilizing devices such as a pressure expanding device or a thermoelectric device, said incorporated heat engine flow circuit, produces useable mechanical energy and/or electrical energy;

ao. rejecting unused waste heat to said sfc sub-ambient temperature heat sink, returning an ihefc working fluid to its initial conditions and starting point, thus said incorporated heat engine flow circuit completes its thermodynamic cycle, and much of that portion of said sustained heat flow that is not converted to useable mechanical energy and/or electrical energy is captured, and is then returned to said cfc super-ambient temperature heat source, for reuse;

ap. utilizing the mechanical energy produced by said incorporated heat engine flow circuit, a mechanical load, or loads, is/are driven directly or indirectly via a mechanical output device to perform useful mechanical work, and/or the generation of electrical energy;

aq. flowing, an hrfc working fluid enters an hrfc ventilation motive device, wherein its velocity is increased;

ar. leading said hrfc working fluid leaving said hrfc ventilation motive device to an hrfc machinery space, and the working fluid is contained within said machinery space by a hermetic envelope formed by the thermally-insulated exterior surfaces of the machinery space;

as. absorbing heat, at substantially constant pressure, said hrfc working fluid captures much of the heat that leaks from a warm exterior surfaces of said motive flow circuit, said conjoined flow circuit, said suction flow circuit, said incorporated heat engine flow circuit, said mechanical output device, said heat recovery flow circuit, and said heat source flow circuit;

at. having absorbed heat, that portion of said hrfc working fluid in close contact with said warm exterior surfaces experiences a decrease in density, thus producing a buoyant force, causing the working fluid to rise toward the ceiling of said hrfc machinery space;

au. collecting the warmed fluid of said hrfc working fluid near the ceiling of said hrfc machinery space an hcdd working fluid inlet leads the working fluid, to one, or more, channels, of an hcdd distribution device;

av. distributing an hcdd working fluid, said hcdd distribution device leads said hcdd working fluid, to one, or more, heat generating devices in said hrfc machinery space that require a cooling medium to remain within allowable operating temperature limits;

aw. absorbing heat, said hcdd working fluid captures much of the waste heat that leaks out of said heat generating devices in said hrfc machinery space;

ax. having absorbed heat while in close contact with said heat generating devices in said hrfc machinery space, said hcdd working fluid experiences a decrease in density, thus producing a buoyant force, causing the working fluid to rise to the upper regions of said hrfc machinery space via an hcdd machinery cooling exhaust collection device;

ay. entering an hrfc heat recycling heat transfer device, said hrfc working fluid rejects heat, via an indirect heat transfer device, to an hhrhtd working fluid;

az. leading the substantially cooled fluid of said hrfc working fluid leaving said hrfc heat recycling heat transfer device to the inlet of said hrfc ventilation motive device, thus returning said hrfc working fluid to its point of origin;

ba. absorbing heat from said hrfc working fluid flowing through an hhrhtd hrfc-hsfc heat recycling evaporative heat transfer device of an hrfc heat recycling heat transfer device, at substantially constant temperature, said hhrhtd working fluid evaporates to produce a vapor;

bb. leading said vapor leaving said hhrhtd hrfc-hsfc heat recycling evaporative heat transfer device to an hhrhtd hrfc-hsfc heat recycling condensing heat transfer device;

bc. condensing in an hhrhtd heat recycling condensing heat transfer device, said vapor rejects its latent heat of vaporization to said heat source flow circuit;

bd. draining out of said hhrhtd heat recycling condensing heat transfer device, the condensed liquid component of said hhrhtd working fluid collects in an hhrhtd working fluid storage device;

be. leading said hhrhtd working fluid leaving said hhrhtd working fluid storage device to said hhrhtd hrfc-hsfc heat recycling evaporative heat transfer device, thus returning said hhrhtd working fluid to its point of origin;

bf. flowing, an hsfc working fluid enters an hsfc fluid transfer device;

bg. pressurizing, at substantially constant entropy, said hsfc working fluid has both its pressure and temperature elevated, thus increasing the specific enthalpy of the working fluid in said heat source flow circuit;

bh. leading said hsfc working fluid leaving said hsfc fluid transfer device to an hsfc fluid filtering device;

bi. filtering, said hsfc working fluid has suspended particulate matter removed as it flows through said hsfc fluid filtering device;

bj. leading said hsfc working fluid leaving said hsfc fluid filtering device to an hsfc fluid import/export device;

bk. flowing through said hsfc fluid import/export device, the quantity of working fluid in said heat source flow circuit may be adjusted;

bl. leading said hsfc working fluid leaving said hsfc fluid import/export device to an hsfc heat source heat transfer device;

bm. absorbing heat, while simultaneously, at substantially constant entropy, experiencing a decrease in pressure and an increase in temperature, said hsfc working fluid extracts replenishment heat, from one, or more, external heat sources, via one, or more, indirect heat transfer devices within said hsfc heat source heat transfer device;

bn. leading said hsfc working fluid leaving said hsfc heat source heat transfer device to an hsfc sfc-hsfc heat recycling heat transfer device;

bo. absorbing heat, while simultaneously, at substantially constant entropy, experiencing a decrease in pressure and an increase in temperature, said hsfc working fluid extracts excess sensible heat from said sfc working fluid flowing through said sfc sfc-hsfc heat recycling heat transfer device, via one, or more, indirect heat transfer devices within said hsfc sfc-hsfc heat recycling heat transfer device;

bp. leading said hsfc working fluid leaving said hsfc sfc-hsfc heat recycling heat transfer device to an hsfc hrfc-hsfc heat recycling heat transfer device;

bq. absorbing heat, while simultaneously, at substantially constant entropy, experiencing a decrease in pressure and an increase in temperature, said hsfc working fluid extracts latent heat from said hhrhtd working fluid flowing through said hhrhtd hrfc-hsfc heat recycling condensing heat transfer device, via one, or more, indirect heat transfer devices within said hhrhtd hrfc-hsfc heat recycling condensing heat transfer device;

br. leading said hsfc working fluid leaving said hsfc hrfc-hsfc heat recycling heat transfer device to an hsfc hsfc-sfc super-heat heat transfer device;

bs. rejecting heat, while simultaneously, at substantially constant entropy, experiencing a decrease in pressure and a decrease in temperature, said hsfc working fluid supplies super-heat to said lesser stream flowing through said shrd hsfc-sfc super-heat heat transfer device, via one, or more indirect heat transfer devices within said hsfc hsfc-sfc super-heat heat transfer device;

bt. leading said hsfc working fluid leaving said hsfc hsfc-sfc super-heat heat transfer device to an hsfc hsfc-sfc evaporative heat transfer device;

bu. rejecting heat, while simultaneously, at substantially constant entropy, experiencing a decrease in pressure and a decrease in temperature, said hsfc working fluid supplies latent heat to said secondary liquid component flowing through said hsfc hsfc-sfc evaporative heat transfer device, via one, or more indirect heat transfer devices within said hsfc hsfc-sfc evaporative heat transfer device;

bv. leading said hsfc working fluid leaving said hsfc hfsc-sfc evaporative heat transfer device to an hsfc hsfc-sfc evaporative heat transfer device working fluid discharge temperature-regulating device;

bw. regulating the discharge temperature of said hsfc working fluid leaving said hsfc hsfc-sfc evaporative heat transfer device, said hsfc hsfc-sfc evaporative heat transfer device working fluid discharge temperature-regulating device automatically acts to maintain an adjustable, substantially constant temperature, which also effectively regulates the fluid flow rate within said heat source flow circuit;

bx. leading said hsfc working fluid leaving said hsfc hsfc-sfc evaporative heat transfer device working fluid discharge temperature-regulating device to an hsfc fluid return device;

by. flowing through said hsfc fluid return device said hsfc working fluid receives any working fluid that may be released by an hssd overpressure relief device, should an overpressure condition warrant such action, said hssd overpressure relief device is interposed between said hsfc fluid import/export device and said hsfc fluid return device; and bt. leading said hsfc working fluid leaving said hsfc fluid return device to said hsfc fluid transfer device, thus returning said hsfc working fluid to its point of origin, whereby a substantial portion of the replenishment heat extracted from an external environmental heat source, or sources, is converted to useable mechanical energy and/or electrical energy, without utilizing an external heat sink, and heat loss is reduced to a minimum due to the substantial portion of waste heat that is recycled by this invention.

2. A method according to claim 1, wherein the following alternative steps are utilized:

j1. leading said greater stream leaving said cspgd motive flow inlet to a cspgd suction chamber, via a cspgd convergent nozzle, said greater stream will xpand, at substantially constant entropy, thus converting a portion of the specific enthalpy of said greater stream to kinetic energy, and thereby accelerate said greater stream to a substantially higher velocity;

j2. entraining a portion of a primary vapor volume found within said cspgd suction chamber, a higher velocity greater stream removes said portion of a primary vapor volume from said cspgd suction chamber, at a point common to said conjoined flow circuit, said motive flow circuit, and said suction flow circuit, thereby generating a region of sub-ambient pressure, thus drawing replacement vapor into the suction chamber via a cspgd suction flow inlet;

j3. exiting said cspgd suction chamber via a cspgd conjoined flow discharge, said higher velocity greater stream and said portion of a primary vapor volume thus entrained, thoroughly mix together, thereby producing a primary saturated mixture;

j4. slowing in said cspgd conjoined flow discharge, said primary saturated mixture compresses, at substantially constant entropy, to produce a super-ambient temperature, super-ambient pressure liquid, as the vapor portion of said primary saturated mixture distributes much of its latent heat of vaporization, to the liquid portion of said primary saturated mixture and condenses therein, thus said cfc sub-ambient pressure generating device combines an mfc working fluid liquid flow with an sfc working fluid vapor flow to produce a cfc working fluid liquid flow, or low quality saturated mixture flow, heated effluent.

3. A method according to claim 1, wherein the following alternative steps are utilized:

i. entering said cfc sub-ambient pressure generating device via a cspgd motive flow inlet, such that said greater stream swirls in said cspgd motive flow inlet;

j1. leading said greater stream leaving said cspgd motive flow inlet to a cspgd suction chamber, at a point common to said conjoined flow circuit, said motive flow circuit, and said suction flow circuit, via a cspgd convergent-divergent nozzle, while traversing the centerline of the convergent portion of said cspgd convergent-divergent nozzle, conservation of angular momentum will impart a substantially greater angular velocity to said greater stream, simultaneously, said greater stream will expand, at substantially constant entropy, upon entering the divergent portion of the nozzle, decreasing centripetal force will allow the pressure of said greater stream to fall below its saturation point, resulting in a portion of the liquid of said greater stream flashing into vapor, to produce a saturated mixture, at a substantially reduced temperature, thus converting a portion of the specific enthalpy of said greater stream to kinetic energy, and thereby accelerate said greater stream to a substantially higher velocity;

j2. entraining a portion of a primary vapor volume found within said cspgd suction chamber, a higher velocity greater stream removes said portion of a primary vapor volume from said cspgd suction chamber, at a point common to said conjoined flow circuit, said motive flow circuit, and said suction flow circuit, thereby generating a region of sub-ambient pressure, thus drawing replacement vapor into the suction chamber via a cspgd suction flow inlet;

j3. exiting said cspgd suction chamber via a cspgd conjoined flow discharge, said higher velocity greater stream and said portion of a primary vapor volume thus entrained, thoroughly mix together, thereby producing a primary saturated mixture;

j4. slowing in said cspgd conjoined flow discharge, said primary saturated mixture compresses, at substantially constant entropy, to produce a super-ambient temperature, super-ambient pressure liquid, as the vapor portion of said primary saturated mixture distributes much of its latent heat of vaporization, to the liquid portion of said primary saturated mixture and condenses therein, thus said cfc sub-ambient pressure generating device combines an mfc working fluid liquid flow with an sfc working fluid vapor flow to produce a cfc working fluid liquid flow, or low quality saturated mixture flow, heated effluent.

4. A method according to claim 1, wherein the following alternative steps are utilized:

j1. leading said greater stream leaving said cspgd motive flow inlet to a cspgd suction chamber, at a point common to said conjoined flow circuit, said motive flow circuit, and said suction flow circuit, via a cspgd fluid transfer device and a cspgd convergent-divergent nozzle combination, said cspgd fluid transfer device accelerates said greater stream to higher traversing and angular velocities, via an impeller, an archimedes' screw, a propeller, or similar propulsive means rotating at a high angular velocity about a central axis, and discharges the swirling higher velocity liquid of said greater stream, without diffusion, into said cspgd convergent-divergent nozzle, while traversing the convergent portion of said cspgd convergent-divergent nozzle, conservation of angular momentum will impart a substantially greater angular velocity to said greater stream as it travels along the nozzle's centerline, simultaneously, said greater stream will expand, at substantially constant entropy, upon entering the divergent portion of the nozzle, decreasing centripetal force will allow the pressure of said greater stream to fall below its saturation point, resulting in a portion of the liquid of said greater stream flashing into vapor, to produce a saturated mixture at a substantially reduced temperature, thus converting a portion of the specific enthalpy of said greater stream to kinetic energy, and thereby accelerate said greater stream to a substantially higher velocity;

j2. entraining a portion of a primary vapor volume found within said cspgd suction chamber, a higher velocity greater stream removes said portion of a primary vapor volume from said cspgd suction chamber, at a point common to said conjoined flow circuit, said motive flow circuit, and said suction flow circuit, thereby generating a region of sub-ambient pressure, thus drawing replacement vapor into the suction chamber via a cspgd suction flow inlet;

j3. exiting said cspgd suction chamber via a cspgd conjoined flow discharge, said higher velocity greater stream and said portion of a primary vapor volume thus entrained, thoroughly mix together, thereby producing a primary saturated mixture;

j4. slowing in said cspgd conjoined flow discharge, said primary saturated mixture compresses, at substantially constant entropy, to produce a super-ambient temperature, super-ambient pressure liquid, as the vapor portion of said primary saturated mixture distributes much of its latent heat of vaporization, to the liquid portion of said primary saturated mixture and condenses therein, thus said cfc sub-ambient pressure generating device combines an mfc working fluid liquid flow with an sfc working fluid vapor flow to produce a cfc working fluid liquid flow, or low quality saturated mixture flow, heated effluent.

5. A method according to claim 1, wherein the following alternative steps are utilized:

j1. leading said greater stream leaving said cspgd motive flow inlet to a cspgd conjoined flow discharge, via a cspgd hydraulic pressure expanding device, wherein the mechanical energy produced by said cspgd hydraulic pressure expanding device is utilized to drive a cspgd compressor;

j2. compressing within said cspgd compressor, at substantially constant entropy, vapor supplied by a cspgd suction flow inlet, has both its pressure and temperature increased substantially, and is then discharged into said cspgd conjoined flow discharge;

j3. combining, said greater stream discharged from said cspgd hydraulic pressure expanding device and the vapor discharged from said cspgd compressor, thoroughly mix together, thereby producing a primary saturated mixture;

j4. slowing in said cspgd conjoined flow discharge, said primary saturated mixture compresses, at substantially constant entropy, to produce a super-ambient temperature, super-ambient pressure liquid, as the vapor portion of said primary saturated mixture distributes much of its latent heat of vaporization, to the liquid portion of said primary saturated mixture and condenses therein, thus said cfc sub-ambient pressure generating device combines an mfc working fluid liquid flow with an sfc working fluid vapor flow to produce a cfc working fluid liquid flow, or low quality saturated mixture flow, heated effluent.

6. A method according to claim 1, wherein the following alternative steps are utilized:

j1. leading said greater stream leaving said cspgd motive flow inlet to a cspgd conjoined flow discharge, via a cspgd convergent-divergent duct, wherein a region of sub-ambient pressure is generated as said greater stream flows through the throat of said cspgd convergent-divergent duct;

j2. drawing a continuous flow of vapor of said lesser stream to the throat of said cspgd convergent-divergent duct from said sfc shrd-cspgd vapor transfer device via a cspgd suction flow inlet;

j3. combining, said greater stream and the vapor supplied by said cspgd suction flow inlet, thoroughly mix together, thereby producing a primary saturated mixture;

j4. slowing in said cspgd conjoined flow discharge, said primary saturated mixture compresses, at substantially constant entropy, to produce a super-ambient temperature, super-ambient pressure liquid, as the vapor portion of said primary saturated mixture distributes much of its latent heat of vaporization, to the liquid portion of said primary saturated mixture and condenses therein, thus said cfc sub-ambient pressure generating device combines an mfc working fluid liquid flow with an sfc working fluid vapor flow to produce a cfc working fluid liquid flow, or low quality saturated mixture flow, heated effluent.

7. A method according to claim 1, wherein the following alternative steps are utilized:

t1. leading said lesser stream leaving said ssftd sfc working fluid inlet to an ssftd suction chamber, via an ssftd convergent nozzle, said lesser stream will expand, at substantially constant entropy, thus converting a portion of the specific enthalpy of said lesser stream to kinetic energy, and thereby accelerate said lesser stream to a substantially higher velocity;

t2. entraining a portion of a primary liquid volume found within said ssftd suction chamber, a higher velocity lesser stream removes said portion of a primary liquid volume from said ssftd suction chamber, thereby generating a region of sub-ambient pressure, thus drawing replacement liquid into the suction chamber via said ssftd shrd excess working fluid inlet;

t3. exiting said ssftd suction chamber via said ssftd working fluid discharge, said higher velocity lesser stream and said portion of a primary liquid volume thus entrained, thoroughly mix together, thereby producing a secondary saturated mixture.

8. A method according to claim 1, wherein the following alternative steps are utilized:

s. entering said sfc shrd-ssths fluid transfer device via said ssftd sfc working fluid inlet, such that said lesser stream swirls in said ssftd sfc working fluid inlet;

t1. leading said lesser stream leaving said ssftd sfc working fluid inlet to said ssftd suction chamber, via an ssftd convergent-divergent nozzle, while traversing the centerline of the convergent portion of said ssftd convergent-divergent nozzle, conservation of angular momentum will impart a substantially greater angular velocity to said lesser stream, simultaneously, said lesser stream will expand, at substantially constant entropy, upon entering the divergent portion of the nozzle, decreasing centripetal force will allow the pressure of said lesser stream to fall below its saturation point, resulting in a portion of the liquid of said lesser stream flashing into vapor, to produce a saturated mixture, at a substantially reduced temperature, thus converting a portion of the specific enthalpy of said lesser stream to kinetic energy, and thereby accelerate said lesser stream to a substantially higher velocity;

t2. entraining a portion of a primary liquid volume found within said ssftd suction chamber, a higher velocity lesser stream removes said portion of a primary liquid volume from said ssftd suction chamber, thereby generating a region of sub-ambient pressure, thus drawing replacement liquid into the suction chamber via said ssftd shrd excess working fluid inlet;

t3. exiting said ssftd suction chamber via said ssftd working fluid discharge, said higher velocity lesser stream and said portion of a primary liquid volume thus entrained, thoroughly mix together, thereby producing a primary saturated mixture.

9. A method according to claim 1, wherein the following alternative steps are utilized:

t1. leading said lesser stream leaving said ssftd sfc working fluid inlet to an ssftd suction chamber, via an ssftd fluid transfer device and an ssftd convergent-divergent nozzle combination, said ssftd fluid transfer device accelerates said greater stream to higher traversing and angular velocities, via an impeller, an archimedes' screw, a propeller, or similar fluid propulsive means, rotating at a high angular velocity about a central axis, and discharges the swirling higher velocity liquid of said lesser stream, without diffusion, into said ssftd convergent-divergent nozzle, while traversing the convergent portion of said ssftd convergent-divergent nozzle, conservation of angular momentum will impart a substantially greater angular velocity to said lesser stream as it travels along the nozzle's centerline, simultaneously, said lesser stream will expand, at substantially constant entropy, upon entering the divergent portion of the nozzle, decreasing centripetal force will allow the pressure of said lesser stream to fall below its saturation point, resulting in a portion of the liquid of said lesser stream flashing into vapor, to produce a saturated mixture, at a substantially reduced temperature, thus converting a portion of the specific enthalpy of said lesser stream to kinetic energy, and thereby accelerate said lesser stream to a substantially higher velocity;

t2. entraining a portion of a primary liquid volume found within said ssftd suction chamber, a higher velocity lesser stream removes said portion of a primary liquid volume from said ssftd suction chamber, thereby generating a region of sub-ambient pressure, thus drawing replacement liquid into the suction chamber via said ssftd sfc working fluid inlet;

t3. exiting said ssftd suction chamber via said ssftd working fluid discharge, said higher velocity lesser stream and said portion of a primary liquid volume thus entrained, thoroughly mix together, thereby producing a primary saturated mixture.

10. A method according to claim 1, wherein the following alternative steps are utilized:

t1. leading said lesser stream leaving said ssftd sfc working fluid inlet to an ssftd working fluid discharge, via an ssftd hydraulic pressure expanding device, wherein the mechanical energy produced by said ssftd hydraulic pressure expanding device is utilized to drive an ssftd fluid transfer device;

t2. pressurizing within said ssftd fluid transfer device, at substantially constant entropy, liquid supplied by said ssftd shrd excess working fluid inlet, has both its pressure and temperature increased substantially, and is then discharged into said ssftd working fluid discharge;

t3. combining, said lesser stream discharged from said ssftd hydraulic pressure expanding device and the liquid discharged from said ssftd fluid transfer device, thoroughly mix together, thereby producing a primary saturated mixture.

11. A method according to claim 1, wherein the following alternative steps are utilized:

t1. leading said lesser stream leaving said ssftd sfc working fluid inlet to said ssftd working fluid discharge, via an ssftd convergent-divergent duct, wherein a region of sub-ambient pressure is generated as said lesser stream flows through the throat of said ssftd convergent-divergent duct;

t2. drawing a continuous flow of liquid of an shrd excess working fluid to the throat of said ssftd convergent-divergent duct from said ssftd shrd excess working fluid inlet;

t3. combining, said lesser stream and the liquid supplied by said ssftd shrd excess working fluid inlet, thoroughly mix together, and are discharged into a region of sub-ambient pressure, below the saturation point of said ssftd working fluid, thereby producing a primary saturated mixture.

12. A method according to claim 1, wherein replenishment heat may be extracted from an external environmental heat source, or sources, whenever said external environmental heat source's temperature is marginally greater than the internal temperature of said sfc heat replenishment device.

13. An apparatus for converting heat to useable mechanical energy and/or electrical energy by continuously and concurrently generating a super-ambient temperature heat source and a sub-ambient temperature heat sink, whose temperature differential is sufficient to develop and sustain a heat flow capable of fueling the operation of an incorporated heat engine, within a thermal power plant, one which recycles much of its own waste heat, without utilizing an external heat sink, also said sub-ambient temperature heat sink captures for reuse much of the waste heat rejected by said incorporated heat engine, further said sub ambient temperature heat sink has a temperature sufficiently low enough to extract replenishment heat from an external environmental heat source, or sources, sufficient to fuel the operation of said thermal power plant, comprising:

a. a cfc flow divider to divide the volatile liquid of a cfc working fluid, flowing in a conjoined flow circuit into two unequal streams, and directing a greater stream to a motive flow circuit and a lesser stream to a suction flow circuit, at an ambient conditions datum, a point located within a cfd flow separation chamber common to said conjoined flow circuit, said motive flow circuit, said suction flow circuit, and a cfd fluid import/export device which provides fluid communication between said conjoined flow circuit and a cfc safety/service device which is interposed between said cfd fluid import/export device and an sfc shrd-ssths fluid transfer device;

b. a conduit means to transport said greater stream leaving said cfc flow divider to an mfc fluid transfer device;

c. said mfc fluid transfer device to impart a super-ambient pressure to said greater stream, and enable said greater stream to flow to a region of sub ambient pressure;

d. a conduit means to transport said greater stream leaving said mfc fluid transfer device to an mfc fluid filtering device;

e. said mfc fluid filtering device to remove suspended particulate matter from said greater stream as the stream passes through the filtering device;

f. a conduit means to transport said greater stream leaving said mfc fluid filtering device to an mfc fluid flow-regulating device;

g. said mfc fluid flow-regulating device to adjustably, automatically, control the flow rate of said greater stream in said motive flow circuit;

h. a conduit means to transport said greater stream leaving said mfc fluid flow-regulating device to a cfc sub-ambient pressure generating device;

i. said cfc sub-ambient pressure generating device to generate a region of sub-ambient pressure, to enable the complete evaporation of the liquid supplied to said lesser stream, at a temperature marginally above the freezing point of a shrd working fluid, and to subsequently compress the vapor produced, at substantially constant entropy, thus reforming the liquid flow, or low quality saturated mixture flow, of said cfc working fluid at a super-ambient pressure and a super-ambient temperature, to produce a heated effluent;

j. a conduit means to transport said heated effluent leaving said cfc sub-ambient pressure generating device to a cfc super-ambient temperature heat source;

k. said cfc super-ambient temperature heat source to supply heat to an incorporated heat engine flow circuit, via one, or more, indirect heat transfer devices located within the heat source, thus substantially cooling said cfc working fluid as it flows through the heat source;

l. a conduit means to transport said cfc working fluid leaving said cfc super-ambient temperature heat source to said cfc flow divider, thus returning said cfc working fluid, at ambient pressure and ambient temperature, to said ambient conditions datum;

m. a conduit means to transport said lesser stream leaving said cfc flow divider to an sfc fluid flow-regulating device;

n. said sfc fluid flow-regulating device to adjustably, automatically, control the flow rate of said lesser stream in said suction flow circuit;

o. a conduit means to transport said lesser stream leaving said sfc fluid flow-regulating device to an sfc sfc-hsfc heat recycling heat transfer device;

p. said sfc sfc-hsfc heat recycling heat transfer device to enable said lesser stream to reject excess sensible heat to a heat source flow circuit, via one, or more, indirect heat transfer devices located within said sfc sfc-hsfc heat recycling heat transfer device;

q. a conduit means to transport said lesser stream leaving said sfc sfc-hsfc heat recycling heat transfer device to said sfc shrd-ssths fluid transfer device;

r. said sfc shrd-ssths fluid transfer device to generate a region of sub-ambient pressure, to enable extraction of excess working fluid transported to an sfc heat replenishment device, and to produce a secondary saturated mixture;

s. a conduit means to transport said said secondary saturated mixture leaving said sfc shrd-ssths fluid transfer device to an sfc sub-ambient temperature heat sink;

t. an ssths ihefc-sfc evaporative heat transfer device of said sfc sub-ambient temperature heat sink to receive the substantial amounts of waste heat rejected by said incorporated heat engine flow circuit, by converting a portion of the liquid of said secondary saturated mixture to vapor, thus enabling said incorporated heat engine flow circuit to complete its thermodynamic cycle;

u. an ssths liquid/vapor separation device to separate said secondary saturated mixture leaving said ssths ihefc-sfc evaporative heat transfer device of said sfc sub-ambient temperature heat sink into a secondary liquid component and a secondary vapor component, and directing said secondary liquid component to an shrd hsfc-sfc evaporative heat transfer device ssths liquid supply device and said secondary vapor component to an ssths ihefc-sfc evaporative heat transfer device pressure-regulating device;

v. said ssths ihefc-sfc evaporative heat transfer device pressure-regulating device to adjustably, automatically, control the internal pressure of said ssths ihefc-sfc evaporative heat transfer device, and simultaneously regulate the internal temperature of the heat transfer device, at a substantially constant, sub-ambient value;

w. an shrd hsfc-sfc evaporative heat transfer device ssths vapor supply device to transport said secondary vapor component leaving said ssths evaporative heat transfer device pressure-regulating device to said sfc heat replenishment device, to a point upstream of an shrd liquid/vapor separation device;

x. an shrd hsfc-sfc evaporative heat transfer device ssths liquid supply device to transport said secondary liquid component leaving said ssths liquid/vapor separation device to said sfc heat replenishment device;

y. an shrd hsfc-sfc evaporative heat transfer device of said sfc heat replenishment device to convert a portion of the liquid supplied by said shrd hsfc-sfc evaporative heat transfer device liquid supply device to vapor, and simultaneously, substantially cooling an hsfc working fluid discharged from said hsfc hsfc-sfc super-heat heat transfer device;

z. an shrd liquid/vapor separation device to separate a tertiary saturated mixture leaving said shrd hsfc-sfc evaporative heat transfer device of said sfc heat replenishment device into a tertiary liquid component and a tertiary vapor component, and directing excess liquid of said tertiary liquid component to said sfc shrd-ssths fluid transfer device and said tertiary vapor component to said shrd hsfc-sfc super-heat heat transfer device, combining with said tertiary saturated mixture prior to its passing through said shrd liquid/vapor separation device is said secondary vapor component supplied by said shrd hsfc-sfc evaporative heat transfer device ssths vapor supply device, thus increasing the proportion of vapor that is discharged from the separation device;

aa. said shrd hsfc-sfc super-heat heat transfer device to supply super-heat to a homogenous vapor formed by the thorough mixing together of said secondary vapor component and said tertiary vapor component, while simultaneously, substantially cooling said hsfc working fluid flowing through said hsfc hsfc-sfc super-heat heat transfer device;

ab. an shrd hsfc-sfc evaporative heat transfer device pressure-regulating device to adjustably, automatically, control the internal pressure of said shrd hsfc-sfc evaporative heat transfer device, and simultaneously regulate the internal temperature of the heat transfer device, at a substantially constant, sub-ambient value;

ac. an sfc shrd-cspgd vapor transfer device to transport the super-heated vapor discharged from said shrd hsfc-sfc evaporative heat transfer device pressure-regulating device to said cfc sub-ambient pressure generating device;

ad. a conduit means to transport the excess liquid of said tertiary liquid component leaving said sfc heat replenishment device to said sfc shrd-ssths fluid transfer device;

ae. said incorporated heat engine flow circuit to receive a useable heat flow from said cfc super-ambient temperature heat source, to convert a portion of said useable heat flow to useable mechanical energy and/or electrical energy, and to reject much of the unused waste heat to said sfc sub-ambient temperature heat sink, for subsequent reuse;

af. a mechanical output device to conduct the mechanical energy produced by a thermal energy to mechanical energy conversion device of said incorporated heat engine flow circuit, from the interior of the flow circuit, to a mod driven mechanical device located outside of the flow circuit and inside of an hrfc machinery space;

ag. an hrfc ventilation motive device to impart a flow to an hrfc working fluid;

ah. said hrfc machinery space to enclose some of the elements of a thermal power plant, and to form a thermally-insulated, hermetic envelope surrounding the enclosed elements of said thermal power plant;

ai. an hms cooling distribution device to capture the heat that leaks from, and/or is rejected by, the elements enclosed within said hrfc machinery space, and lead the heated fluid of an hcdd working fluid to an hrfc heat recycling heat transfer device;

aj. said hrfc heat recycling heat transfer device to extract heat from said hcdd working fluid flowing through said hrfc heat recycling heat transfer device, and to supply the extracted heat to an hhrhtd hrfc-hsfc heat recycling evaporative heat transfer device, to evaporate an hhrhtd working fluid;

ak. a conduit means to transport the vapor produced in said hhrhtd hrfc-hsfc heat recycling heat transfer device to an hhrhtd heat recycling condensing heat transfer device;

al. said hhrhtd heat recycling condensing heat transfer device to remove the latent heat of vaporization of the vapor of said hhrhtd working fluid, and to supply the removed heat to said hsfc working fluid flowing through said hsfc hrfc-hsfc heat recycling heat transfer device;

am. a conduit means to transport the condensate produced in said hhrhtd heat recycling heat transfer device to an hhrhtd working fluid storage device;

an. said hhrhtd working fluid storage device to store a liquid volume of said hhrhtd working fluid;

ao. a conduit means to transport said hhrhtd working fluid leaving said hhrhtd working fluid storage device to said hhrhtd heat recycling evaporative heat transfer device;

ap. an hsfc fluid transfer device to impart a flow to said hsfc working fluid flowing in said heat source flow circuit;

aq. a conduit means to transport said hsfc working fluid leaving said hsfc fluid transfer device to an hsfc fluid filtering device;

ar. said hsfc fluid filtering device to remove suspended particulate matter from said hsfc working fluid as it flows through the filtering device;

as. a conduit means to transport said hsfc working fluid leaving said hsfc fluid filtering device to an hsfc fluid import/export device;

at. said hsfc fluid import/export device to enable the quantity of said hsfc working fluid flowing in said heat source flow circuit to be adjusted, said hsfc fluid import/export device provides fluid communication between said heat source flow circuit and an hsfc safety/service device, which is interposed between said hsfc fluid import/export device and an hsfc fluid return device;

au. a conduit means to transport said hsfc working fluid leaving said hsfc fluid import/export device to an hsfc heat source heat transfer device;

av. said hsfc heat source heat transfer device to extract replenishment heat from an external environmental heat source, or sources;

aw. a conduit means to transport said hsfc working fluid leaving said hsfc heat source heat transfer device to an hsfc sfc-hsfc heat recycling heat transfer device;

ax. said hsfc sfc-hsfc heat recycling heat transfer device to enable said lesser stream flowing through said sfc sfc-hsfc heat recycling heat transfer device to cool substantially, by rejecting excess sensible heat to said hsfc working fluid flowing through said hsfc sfc-hsfc heat recycling heat transfer device;

ay. a conduit means to transport said hsfc working fluid leaving said hsfc sfc-hsfc heat recycling heat transfer device to an hsfc hrfc-hsfc heat recycling heat transfer device;

az. said hsfc hrfc-hsfc heat recycling heat transfer device to extract the latent heat of vaporization of the vapor of said hhrhtd working fluid flowing through said hhrhtd hrfc-hsfc heat recycling condensing heat transfer device;

ba. a conduit means to transport said hsfc working fluid leaving said hsfc hrfc-hsfc heat recycling heat transfer means to an hsfc hsfc-sfc super-heat heat transfer device;

bb. said hsfc hsfc-sfc super-heat heat transfer device to supply super-heat to said homogenous vapor formed within said sfc heat replenishment device;

bc. a conduit means to transport said hsfc working fluid leaving said hsfc hsfc-sfc super-heat heat transfer device to an hsfc hsfc-sfc evaporative heat transfer device;

bd. said hsfc hsfc-sfc evaporative heat transfer device to supply latent heat to said secondary liquid component flowing through said shrd hsfc-sfc evaporative heat transfer device;

be. a conduit means to transport said hsfc working fluid leaving said hsfc hfc-sfc evaporative heat transfer device to an hsfc hsfc-sfc evaporative heat transfer device working fluid discharge temperature-regulating device;

bf. said hsfc hsfc-sfc evaporative heat transfer device working fluid discharge temperature-regulating device to adjustably, automatically, control the temperature of said hsfc working fluid leaving the temperature-regulating device, which effectively regulates the flow of said hsfc working fluid in said heat source flow circuit;

bg. a conduit means to transport said hsfc working fluid leaving said hsfc hsfc-sfc evaporative heat transfer device working fluid discharge temperature-regulating device to said hsfc fluid return device;

bh. said hsfc fluid return device to enable an hssd working fluid to enter said heat source flow circuit should conditions warrant the release of said hssd working fluid by an hssd overpressure relief device; and bi. a conduit means to transport said hsfc working fluid leaving said hsfc fluid return device to said hsfc fluid transfer device, whereby a substantial portion of the replenishment heat extracted from an external environmental heat source, or sources, is converted to useable mechanical energy and/or electrical energy, without utilizing an external heat sink, and heat loss is reduced to a minimum due to the substantial portion of waste heat that is recycled by this invention.

14. An apparatus according to claim 13, wherein the following alternative elements are utilized:

i1. a cspgd convergent nozzle to accelerate said greater stream to a higher velocity fluid;

i2. a cspgd suction chamber where vapor supplied by said lesser stream is entrained by said higher velocity fluid of said greater stream discharged from said cspgd convergent nozzle, thereby generating a region of sub-ambient pressure;

i3. a cspgd conjoined flow discharge to promote thorough mixing of the working fluids supplied by said greater stream and said lesser stream, and to diffuse a resultant mixture, to produce a heated effluent, at a super-ambient pressure and a super-ambient temperature.

15. An apparatus according to claim 13, wherein the following alternative elements are utilized:

i1. a cspgd motive flow inlet which promotes swirling by said greater stream as it is admitted to said cfc sub-ambient pressure generating device;

i2. a cspgd convergent-divergent nozzle to accelerate said greater stream to a higher velocity fluid;

i3. a cspgd suction chamber where vapor supplied by said lesser stream is entrained by said higher velocity fluid of said greater stream discharged from said cspgd convergent-divergent nozzle, thereby generating a region of sub-ambient pressure;

i4. a cspgd conjoined flow discharge to promote thorough mixing of the working fluids supplied by said greater stream and said lesser stream, and to diffuse a resultant mixture, to produce a heated effluent, at a super-ambient pressure and a super-ambient temperature.

16. An apparatus according to claim 13, wherein the following alternative elements are utilized:

i1. a cspgd fluid transfer device to impart a flow and a swirl to said greater stream;

i2. a cspgd convergent-divergent nozzle to accelerate said greater stream to a higher velocity fluid;

i3. a cspgd suction chamber where vapor supplied by said lesser stream is entrained by said higher velocity fluid of said greater stream discharged from said cspgd convergent-divergent nozzle, thereby generating a region of sub-ambient pressure;

i4. a cspgd conjoined flow discharge to promote thorough mixing of the working fluids supplied by said greater stream and said lesser stream, and to diffuse a resultant mixture, to produce a heated effluent, at a super-ambient pressure and a super-ambient temperature.

17. An apparatus according to claim 13, wherein the following alternative elements are utilized:

i1. a cspgd hydraulic pressure expanding device to utilize the pressure energy of said greater stream to generate mechanical energy to drive a cspgd compressor;

i2. a cspgd compressor to generate a region of sub-ambient pressure, and to discharge said lesser stream at a super-ambient pressure;

i3. a cspgd conjoined flow discharge to promote thorough mixing of the working fluids supplied by said greater stream and said lesser stream, and to diffuse a resultant mixture, to produce a heated effluent, at a super-ambient pressure and a super-ambient temperature.

18. An apparatus according to claim 13, wherein the following alternative elements are utilized:

i1. a convergent portion of a cspgd convergent-divergent duct to accelerate said greater stream to a higher velocity fluid in a cspgd throat of said cspgd convergent-divergent duct, thereby generating a region of sub-ambient pressure, to draw a continual stream of vapor from said lesser stream to said cspgd throat;

i2. said cspgd throat of said cspgd convergent-divergent duct to promote thorough mixing of the working fluids supplied by said greater stream and said lesser stream, said lesser stream having been entrained by said higher velocity fluid of said greater stream;

i3. a divergent portion of said cspgd convergent-divergent duct to diffuse a resultant mixture, to produce a heated effluent, at a super-ambient pressure and a super-ambient temperature.

19. An apparatus according to claim 13, wherein the following alternative elements are utilized:

r1. an ssftd convergent nozzle to accelerate said lesser stream to a higher velocity fluid;

r2. an ssftd suction chamber where liquid supplied by an sfc shrd-ssftd excess tertiary liquid component transfer device is entrained by said higher velocity fluid of said lesser stream discharged from said ssftd convergent nozzle, thereby generating a region of sub-ambient pressure;

r3. an ssftd working fluid discharge to promote thorough mixing of the working fluids supplied by said lesser stream and said sfc shrd-ssftd excess tertiary liquid component transfer device, and to diffuse a resultant mixture, to produce said secondary saturated mixture at a sub-ambient pressure, and a temperature marginally above the freezing point of said resultant mixture.

20. An apparatus according to claim 13, wherein the following alternative elements are utilized:

r1. an ssftd sfc working fluid inlet, which promotes swirling by said lesser stream as it, is admitted to said sfc sfc-ssths fluid transfer device;

r2. an ssftd convergent-divergent nozzle to accelerate said lesser stream to a higher velocity fluid;

r3. an ssftd suction chamber where liquid supplied by said sfc shrd-ssftd excess tertiary liquid component transfer device is entrained by said higher velocity fluid of said lesser stream discharged from said ssftd convergent-divergent nozzle, thereby generating a region of sub-ambient pressure;

r4. an ssftd working fluid discharge to promote thorough mixing of the working fluids supplied by said lesser stream and said sfc shrd-ssftd excess tertiary liquid component transfer device, and to diffuse a resultant mixture, to produce said secondary saturated mixture at a sub-ambient pressure, and a temperature marginally above the freezing point of said resultant mixture.

21. An apparatus according to claim 13, wherein the following alternative elements are utilized:

r1. an ssftd fluid transfer device to impart a flow and a swirl to said lesser stream;

r2. an ssftd convergent-divergent nozzle to accelerate said lesser stream to a higher velocity fluid;

r3. an ssftd suction chamber where liquid supplied by said sfc shrd-ssths is entrained by said higher velocity fluid of said lesser stream discharged from said ssftd convergent-divergent nozzle, thereby generating a region of sub-ambient pressure;

r4. an ssftd working fluid discharge to promote thorough mixing of the working fluids supplied by said lesser stream and said sfc shrd-ssftd excess tertiary liquid component transfer device, and to diffuse a resultant mixture, to produce said secondary saturated mixture at a sub-ambient pressure, and a temperature marginally above the freezing point of said resultant mixture.

22. An apparatus according to claim 13, wherein the following alternative elements are utilized:

r1. an ssftd hydraulic pressure expanding device to utilize the pressure energy of said lesser stream to generate mechanical energy to drive an ssftd fluid transfer device;

r2. an ssftd fluid transfer device to generate a region of sub-ambient pressure, and to discharge the liquid supplied by said sfc shrd-ssftd excess tertiary liquid component transfer device, at an elevated sub-ambient pressure;

r3. an ssftd working fluid discharge to promote thorough mixing of the working fluids supplied by said lesser stream and said sfc shrd-ssftd excess tertiary liquid component transfer device, and to diffuse a resultant mixture, to produce said secondary saturated mixture at a sub-ambient pressure, and a temperature marginally above the freezing point of said resultant mixture.

23. An apparatus according to claim 13, wherein the following alternative elements are utilized:

r1. a convergent portion of an ssftd convergent-divergent duct to accelerate said lesser stream to a higher velocity fluid in an ssftd throat of said ssftd convergent-divergent duct, thereby generating a region of sub-ambient pressure, to draw a continual stream of liquid from said sfc shrd-ssftd excess tertiary liquid component transfer device to said ssftd throat;

r2. said ssftd throat of said ssftd convergent-divergent duct to promote thorough mixing of the working fluids supplied by said lesser stream and said sfc shrd-ssftd excess tertiary liquid component transfer device, the liquid supplied by said sfc shrd-ssftd excess tertiary component having been entrained by said higher velocity fluid of said lesser stream;

r3. a divergent portion of said ssftd convergent-divergent duct to diffuse a resultant mixture, to produce said secondary saturated mixture at a sub-ambient pressure, and a temperature marginally above the freezing point of said resultant mixture.

24. An apparatus according to claim 13, wherein replenishment heat is extracted from an external environmental heat source, or sources, whose temperature is marginally greater than the internal temperature of said sfc heat replenishment device.

* * * * *